US009402132B2

(12) United States Patent
Park et al.

(10) Patent No.: US 9,402,132 B2
(45) Date of Patent: Jul. 26, 2016

(54) LIMITING ACTIVE NOISE CANCELLATION OUTPUT

(71) Applicant: QUALCOMM Incorporated, San Diego, CA (US)

(72) Inventors: Hyun Jin Park, San Diego, CA (US); Deepak Kumar Challa, San Diego, CA (US); Song Wang, San Diego, CA (US); Dinesh Ramakrishnan, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 49 days.

(21) Appl. No.: 14/477,685

(22) Filed: Sep. 4, 2014

(65) Prior Publication Data

US 2015/0104031 A1 Apr. 16, 2015

Related U.S. Application Data

(60) Provisional application No. 61/890,833, filed on Oct. 14, 2013.

(51) Int. Cl.
*H04R 3/00* (2006.01)
*G10K 11/178* (2006.01)

(52) U.S. Cl.
CPC ..... *H04R 3/002* (2013.01); *G10K 11/1788* (2013.01); *G10K 2210/108* (2013.01); *G10K 2210/3039* (2013.01); *G10K 2210/3056* (2013.01); *H04R 2410/05* (2013.01)

(58) Field of Classification Search
None
See application file for complete search history.

(56) References Cited

U.S. PATENT DOCUMENTS

| | | | | |
|---|---|---|---|---|
| 6,999,541 | B1 * | 2/2006 | Hui | G10K 11/1786 375/347 |
| 8,165,875 | B2 | 4/2012 | Hetherington et al. | |
| 8,515,089 | B2 | 8/2013 | Nicholson | |
| 2002/0141599 | A1 | 10/2002 | Trajkovic et al. | |
| 2003/0198357 | A1 * | 10/2003 | Schneider | G10L 21/0208 381/94.2 |
| 2011/0007907 | A1 * | 1/2011 | Park | G10K 11/178 381/71.8 |
| 2011/0249826 | A1 | 10/2011 | Van Leest | |
| 2011/0286606 | A1 * | 11/2011 | Al-Naimi | G10K 11/1788 381/71.1 |
| 2012/0308021 | A1 * | 12/2012 | Kwatra | G10K 11/1788 381/71.1 |
| 2013/0129105 | A1 * | 5/2013 | Hua | H04R 1/1083 381/71.6 |

(Continued)

FOREIGN PATENT DOCUMENTS

| | | | | |
|---|---|---|---|---|
| EP | 2701143 | A1 | 2/2014 | |
| GB | 2455823 | A | 6/2009 | |
| GB | 2500251 | * | 9/2013 | H04R 1/10 |

OTHER PUBLICATIONS

International Search Report and Written Opinion from International Searching Authority for PCT/US2014/054220, dated Mar. 2, 2015, 11 pp.

(Continued)

*Primary Examiner* — Brenda Bernardi
(74) *Attorney, Agent, or Firm* — Shumaker & Sieffert, P.A.

(57) ABSTRACT

In general, techniques are described for limiting active noise cancellation output. As one example, an apparatus comprising one or more processors may perform the techniques. The one or more processors may be configured to, when an estimated noise level increases, dynamically lowering application of active noise cancellation to at least a portion of an audio signal to obtain at least a portion of an active noise cancelled version of the audio signal.

28 Claims, 16 Drawing Sheets

(56) References Cited

U.S. PATENT DOCUMENTS

| | | | | |
|---|---|---|---|---|
| 2015/0023515 | A1* | 1/2015 | Reimert | H04R 1/1083 381/71.6 |
| 2015/0071453 | A1* | 3/2015 | Po | G10K 11/175 381/71.11 |

OTHER PUBLICATIONS

Response to Written Opinion dated Mar. 2, 2015, from International Searching Authority for PCT/US2014/054220, filed on Aug. 14, 2015, 5 pp.

Written Opinion from International Searching Authority for PCT/US2014/054220, dated Dec. 23, 2015, 7 pp.

Response to Written Opinion dated Dec. 23, 2015, from International Searching Authority for PCT/US2014/054220, filed on Jan. 22, 2016, 24 pp.

Written Opinion from International Searching Authority for PCT/US2014/054220, dated Feb. 22, 2016, 10 pp.

Response to Written Opinion dated Feb. 22, 2016, from International Searching Authority for PCT/US2014/054220, filed on Mar. 8, 2016, 9 pp.

* cited by examiner

LIMITING ACTIVE NOISE CANCELLATION OUTPUT

This application claims the benefit of U.S. Provisional Application No. 61/890,833, filed Oct. 14, 2013.

TECHNICAL FIELD

The invention relates to audio signal processing and, more specifically, applying active noise cancellation to audio signals.

BACKGROUND

Some computing devices (e.g., cellular phones, smartphones, headphones, music players, etc.) may be used in noisy environments. For example, a cellular phone may be used in an airport where environmental, background or ambient noise may be distracting to a user. For instance, a user may be engaged in a phone call while others are talking nearby or while an airplane is taking off. These environmental noises may make it difficult for an user of the computing device to hear audio signals (e.g., speech, music, etc.) output from the computing device. Active noise cancellation refers to a way by which to adjust audio signals to account for environmental, background or ambient noises.

SUMMARY

In general, techniques are described for limiting active noise cancellation output.

In one aspect, a method comprises dynamically adjusting, based on an estimated noise level, application of active noise cancellation to at least a portion of an audio signal to obtain at least a portion of an active noise cancelled version of the audio signal.

In another aspect, an apparatus comprises one or more processors configured to dynamically adjust, based on an estimated noise level, application of active noise cancellation to at least a portion of an audio signal to obtain at least a portion of an active noise cancelled version of the audio signal.

In another aspect, an apparatus comprises means for determining at least a portion of an audio signal, and means for dynamically adjusting, based on an estimated noise level, application of active noise cancellation to at least the portion of the audio signal to obtain at least a portion of an active noise cancelled version of the audio signal.

In another aspect, a non-transitory computer-readable storage medium has stored thereon instructions that, when executed, cause one or more processors to dynamically adjust, based on an estimated noise level, application of active noise cancellation to at least a portion of an audio signal to obtain at least a portion of an active noise cancelled version of the audio signal.

The details of one or more aspects of the techniques are set forth in the accompanying drawings and the description below. Other features, objects, and advantages of the techniques will be apparent from the description and drawings, and from the claims.

DETAILED DESCRIPTION

Figure 1A:
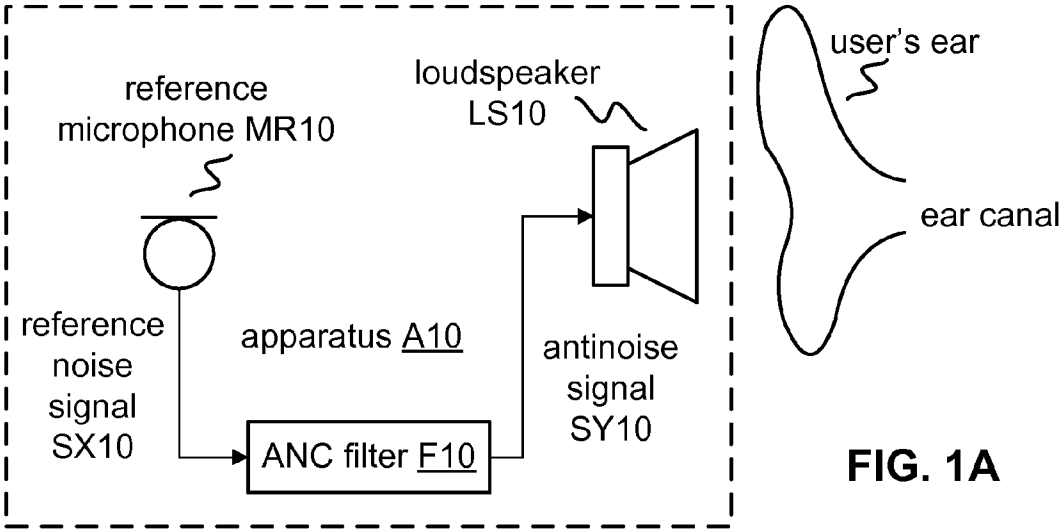
FIG. 1A is a block diagram illustrating an example of an ANC apparatus that includes a feed-forward ANC filter and a reference microphone that is disposed to sense ambient noise.

The devices, apparatuses, systems and methods disclosed herein may be applied to a variety of computing devices. Examples of computing devices include cellular phones, smartphones, headphones, video cameras, audio players (e.g., Moving Picture Experts Group-1 (MPEG-1) or MPEG-2 Audio Layer 3 (MP3) players), video players, audio recorders, desktop computers/laptop computers, personal digital assistants (PDAs), gaming systems, etc. One kind of computing device is a communication device, which may communicate with another device. Examples of communication devices include telephones, laptop computers, desktop computers, cellular phones, smartphones, e-readers, tablet devices, gaming systems, etc.

A computing device or communication device may operate in accordance with certain industry standards, such as International Telecommunication Union (ITU) standards and/or Institute of Electrical and Computing Engineers (IEEE) standards (e.g., Wireless Fidelity or "Wi-Fi" standards such as 802.11a, 802.11b, 802.11g, 802.11n and/or 802.11 ac). Other examples of standards that a communication device may comply with include IEEE 802.16 (e.g., Worldwide Interoperability for Microwave Access or "WiMAX"), Third Generation Partnership Project (3GPP), 3GPP Long Term Evolution (LTE), Global System for Mobile Telecommunications (GSM) and others (where a communication device may be referred to as a User Equipment (UE), NodeB, evolved NodeB (eNB), mobile device, mobile station, subscriber station, remote station, access terminal, mobile terminal, terminal, user terminal, subscriber unit, etc., for example). While some of the devices, apparatuses, systems and methods disclosed herein may be described in terms of one or more standards, the techniques should not be limited to the scope of the disclosure, as the devices, apparatuses, systems and methods may be applicable to many systems and/or standards.

It should be noted that some communication devices may communicate wirelessly and/or may communicate using a wired connection or link. For example, some communication devices may communicate with other devices using an Ethernet protocol. The devices, apparatuses, systems and methods disclosed herein may be applied to communication devices that communicate wirelessly and/or that communicate using a wired connection or link.

As used herein, the terms, "cancel," "cancellation" and other variations of the word "cancel" may or may not imply a complete cancellation of a signal. For example, if a first signal "cancels" a second signal, the first signal may interfere with the second signal in an attempt to reduce the second signal in amplitude. The resulting signal may or may not be reduced or completely cancelled.

As used herein, the terms "circuit," "circuitry" and other variations of the term "circuit" may denote a structural element or component. For example, circuitry can be an aggregate of circuit components, such as a multiplicity of integrated circuit components, in the form of processing and/or memory cells, units, blocks and the like.

Traditionally, static or non-adaptive active noise control (ANC) consists of a filtering operation and requires a noise signal input. Conventional, non-adaptive ANC may be applied to a handset. In one example of feed-forward ANC, a noise microphone may be placed on the back of the handset, while a speaker (e.g., earpiece, receiver, etc.) may be placed on the front of the handset, which a user may hold near his/her ear. ANC processing may use a noise signal provided by the noise microphone in an attempt to cancel noise by outputting a signal from the speaker.

Adaptive ANC consists of both a filtering operation and an adaptation operation. Typically, an adaptive algorithm for feed-forward (FF) ANC requires an error signal input, which measures the remaining noise signal at a "quiet zone." Thus, traditional adaptive FF ANC may require two input signals. One input signal may include external noise and the other input signal includes an error signal (from an error microphone, for example). The filtering operation may require only the noise signal input. However, the adaptation operation may require both the noise signal input and the error signal input.

In one example of generic adaptive ANC processing, a noise microphone captures a noise signal and an error microphone captures an error signal e(n). In generic adaptive ANC processing, an adaptive algorithm minimizes the error signal e(n), which converges an adaptive filter W(z) to an optimal solution. Converging the adaptive filter may be referred to as an iterative convergence or training process. In this example, $$W(z) = \frac{-P(z)}{S(z)},$$

where P(z) is a first transfer function (e.g., primary path transfer function) and S(z) is a second transfer function (e.g., secondary path transfer function).

Another example of traditional adaptive ANC processing is called filtered-x least mean squares (FxLMS) adaptive ANC processing. This approach also uses an error microphone to capture an error signal e(n). An LMS algorithm uses the captured error signal e(n) to train or converge the adaptive filter W(z).

In one example, conventional adaptive ANC may be applied to a handset. In this example, a noise microphone may be placed on the back of the handset, while a speaker (e.g., earpiece, receiver, etc.) may be placed on the front of the handset, which a user may hold near his/her ear. An error microphone may also be placed on the front of the handset, near the speaker. ANC processing may use a noise signal provided by the noise microphone and an error signal provided by the error microphone in an attempt to cancel noise by outputting a signal from the speaker.

While it may be expensive to implement adaptive ANC (e.g., in terms of processing cycles and/or memory consumption), it may be useful in some applications. For example, applying ANC to a handset earpiece or speaker may be one application of ANC that can be benefited by adaptation, since the acoustic transfer function is highly dynamic and filter adaptation may be used to ensure optimal noise cancellation.

Conventional feed-forward (FF) adaptive active noise control (ANC) typically requires an error microphone (or some other input sensor) to pick up a sound signal at a "quiet zone." This sound signal is usually called an error signal. The microphone that receives the error signal may typically be placed near a speaker (e.g., earpiece, receiver, etc.) to pick up the error signal. In some instances, the microphone that receives the error signal may be used in addition to another microphone used to pick up noise for reduction (e.g., cancellation).

ANC or adaptive ANC (AANC) may, in some instances, increase the gain of the audio signal to be output by the speaker due to the cancellation effects of applying ANC or AANC. That is, when external noise levels are high, the resulting ANC/AANC signal may also have high levels (meaning a higher gain in comparison to the original signal). When input noise levels exceed some extreme level A (which are often expressed in terms of acceptable decibel (dB) levels for an average listening duration, and "extreme" being typically defined as resulting in some non-minimal loss of hearing when exposed to these dB levels over the average listening duration), the ANC/AANC audio signal may exceed a level B, which is over some threshold C (where this threshold is again expressed in terms of dB over an average listening duration, and this threshold is set to avoid non-minimal loss of hearing when exposed to these threshold dB levels over the average listening duration). The resulting ANC/AANC audio signals may result in potential issues, such as saturation in digital systems, speaker damage by excessive excursion and human hearing damage.

The techniques described in this disclosure may turn off or lower ANC/AANC output automatically (meaning without human intervention except for to potentially enable the techniques described in this disclosure) when the input noise level exceeds some given dB threshold level. The techniques may provide for a limit controller that automatically or dynamically adjusts the ANC/AANC output based on the input noise level (e.g., detected via the noise microphone). This limit controller may receive the ANC noise input microphone signal (or other microphone signal or ANC output signal) and control the ANC filter gain based on a determined environmental noise level.

Various aspects of the techniques may involve a noise estimation unit that estimates noise based on the noise microphone signal to determine the environmental noise level and an ANC gain control unit. The noise estimation unit may measure ANC/AANC input signal (or output signal or, in some instances, other microphone signals from which a noise estimation may be derived) loudness over some time period using approaches such as average amplitude, peak amplitude, average power or any combination thereof. For example, when performing noise estimation using average amplitude, the noise estimation unit may estimation the average amplitude by $\sqrt{(\Sigma X(t)^2)/N}$ or $(\Sigma|X(t)|/N$, where X(t) represents the noise signal over time t, and N refers to the number of samples that form the noise signal X(t). The noise estimation unit may estimate the noise level using peak power by computing MAX(|X(t)|), where the MAX(*) function returns a gain value for the sample of the noise signal X(t) having the maximum gain.

The gain control unit may compare the estimated noise level to the threshold level C and turn off or otherwise dynamically adjust lower the ANC when the estimated noise level exceeds the threshold level C. By lowering the ANC output gain (or potentially setting the gain to zero in order to turn ANC off), the techniques may protect against saturation of digital circuits, damage to the speaker, and damage to human hearing.

FIG. 1A is a block diagram illustrating an example A10 of an ANC apparatus that includes a feedforward ANC filter F10 and a reference microphone MR10 that is disposed to sense ambient noise. Filter F10 is arranged to receive a reference noise signal SX10 that is based on a signal produced by reference microphone MR10 and to produce a corresponding antinoise signal SY10. Apparatus A10 also includes a loudspeaker LS10 that is configured to produce an acoustic signal based on antinoise signal SY10. Loudspeaker LS10 is arranged to direct the acoustic signal at or even into the user's ear canal such that the ambient noise is attenuated or canceled before reaching the user's eardrum (also referred to as the "quiet zone"). Apparatus A10 may also be implemented to produce reference noise signal SX10 based on information from signals from more than one instance of reference microphone MR10 (e.g., via a filter configured to perform a spatially selective processing operation, such as beamforming, blind source separation, gain and/or phase analysis, etc.).

As described above, an ANC apparatus may be configured to use one or more microphones (e.g., reference microphone MR10) to sense acoustic noise from the background. Another type of ANC system uses a microphone (possibly in addition to a reference microphone) to pick up an error signal after the noise reduction. An ANC filter in a feedback arrangement is typically configured to inverse the phase of the error signal and may also be configured to integrate the error signal, equalize the frequency response, and/or to match or minimize the delay.

Figure 1B:
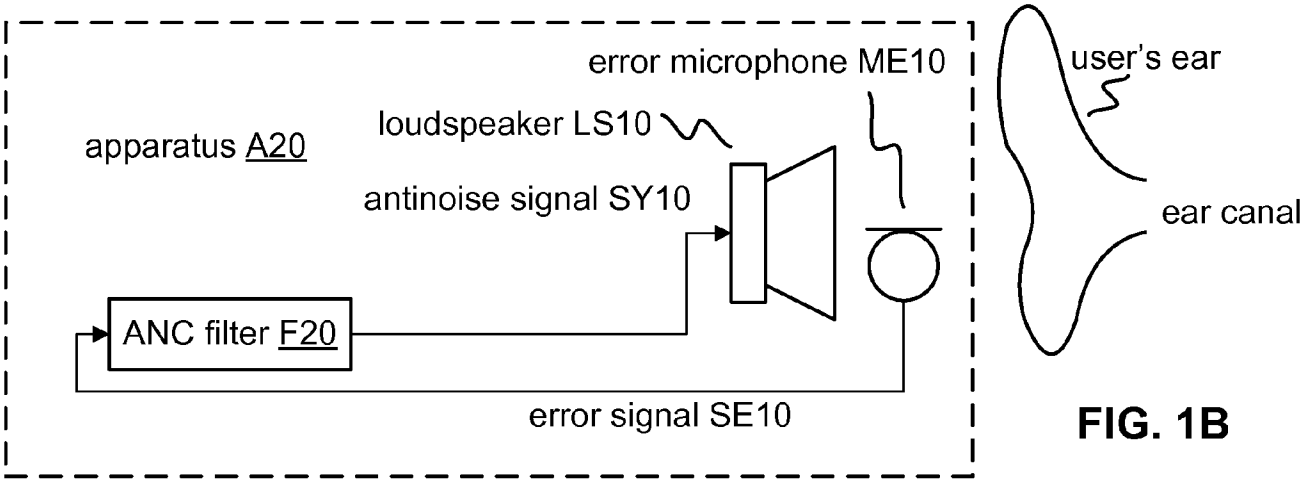
FIG. 1B is a block diagram illustrating an example of an ANC apparatus that includes a feedback ANC filter and an error microphone that is disposed to sense sound produced by a loudspeaker.

FIG. 1B is a block diagram illustrating an example A20 of an ANC apparatus that includes a feedback ANC filter F20 and an error microphone ME10 that is disposed to sense sound at a user's ear canal, including sound (e.g., an acoustic signal based on antinoise signal SY10) produced by loudspeaker LS10. Filter F20 is arranged to receive an error signal SE10 that is based on a signal produced by error microphone ME10 and to produce a corresponding antinoise signal SY10.

In some examples, the ANC filter (e.g., filter F10, filter F20) is configured to generate an antinoise signal SY10 that is matched with the acoustic noise in amplitude and opposite to the acoustic noise in phase. Signal processing operations such as time delay, gain amplification, and equalization or lowpass filtering may be performed to achieve optimal noise cancellation. In some instances, the ANC filter may be configured to high-pass filter the signal (e.g., to attenuate high-amplitude, low-frequency acoustic signals). Additionally or alternatively, the ANC filter may be configured to low-pass filter the signal (e.g., such that the ANC effect diminishes going toward higher frequencies). Because the antinoise signal should be available by the time the acoustic noise travels from the microphone to the actuator (i.e., loudspeaker LS10), the processing delay caused by the ANC filter should not exceed a very short time (typically about thirty to sixty microseconds).

Filter F10 includes a digital filter, such that ANC apparatus A10 may be configured to perform analog-to-digital conversion on the signal produced by reference microphone MR10 to produce reference noise signal SX10 in digital form. Similarly, filter F20 includes a digital filter, such that ANC apparatus A20 may be configured to perform analog-to-digital conversion on the signal produced by error microphone ME10 to produce error signal SE10 in digital form. Examples of other preprocessing operations that may be performed by the ANC apparatus upstream of the ANC filter in the analog and/or digital domain include spectral shaping (e.g., low-pass, high-pass, and/or band-pass filtering), echo cancellation (e.g., on error signal SE10), impedance matching, and gain control. For example, the ANC apparatus (e.g., apparatus A10) may be configured to perform a high-pass filtering operation (e.g., having a cutoff frequency of 50, 100, or 200 Hz) on the signal upstream of the ANC filter.

The ANC apparatus may also include a digital-to-analog converter (DAC) arranged to convert antinoise signal SY10 to analog form upstream of loudspeaker LS10. In some instances, the ANC apparatus may be configured to mix a desired sound signal with the antinoise signal (in either the analog or digital domain) to produce an audio output signal for reproduction by loudspeaker LS10. Examples of such desired sound signals include a received (i.e. far-end) voice communications signal, a music or other multimedia signal, and a sidetone signal.

Figure 2B:
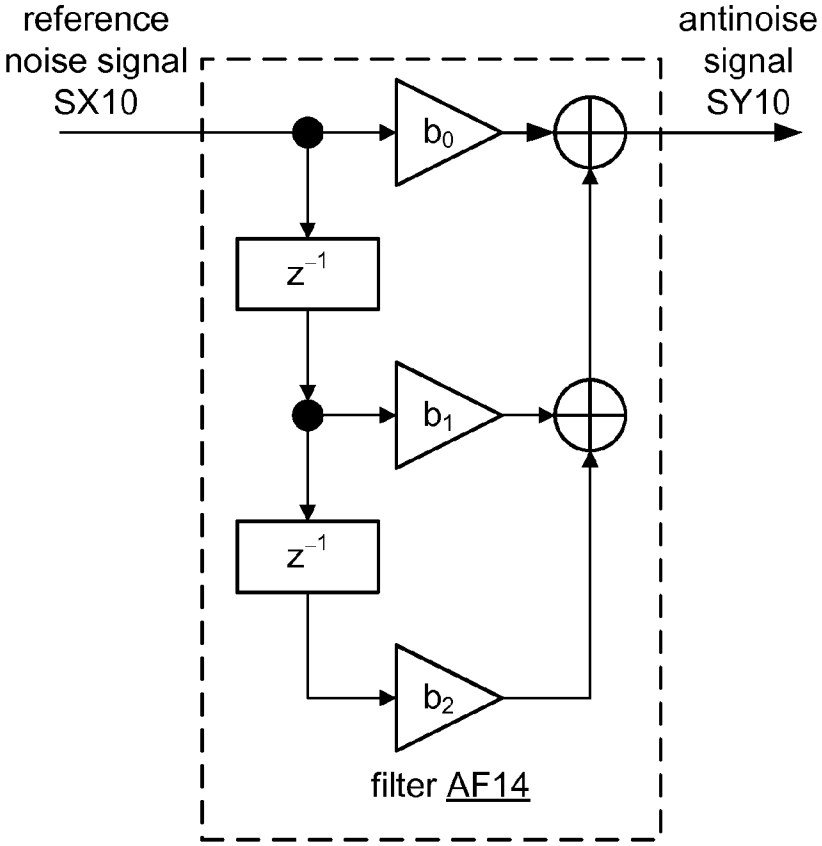
FIG. 2B is a block diagram illustrating an alternate implementation of a FIR filter.
Figure 2A:
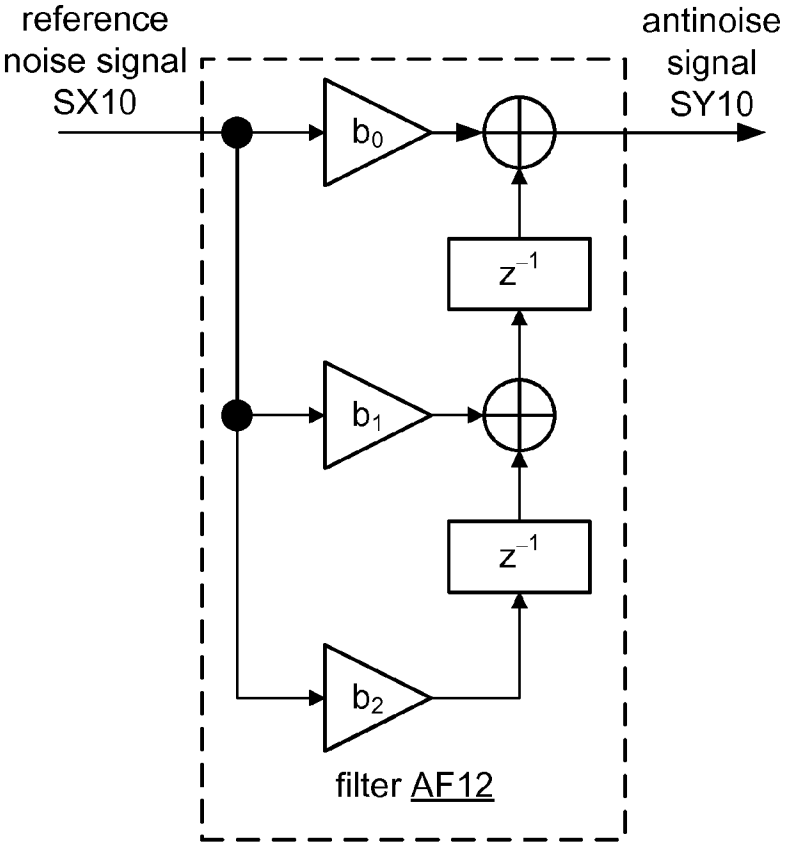
FIG. 2A is a block diagram illustrating a finite-impulse-response (FIR) implementation of a feed-forward ANC filter.

FIG. 2A is a block diagram illustrating a finite-impulse-response (FIR) implementation AF12 of feedforward ANC filter AF10. In this example, filter AF12 has a transfer function $B(z)=b_0+b_1*z^{-1}+b_2*z^{-2}$ that is defined by the values of the filter coefficients (i.e., feedforward gain factors $b_0$, $b_1$, and $b_2$). Although a second-order FIR filter is shown in this example, an FIR implementation of filter AF10 may include any number of FIR filter stages (i.e., any number of filter coefficients), depending on factors such as maximum allowable delay. For a case in which reference noise signal SX10 is one bit wide, each of the filter coefficients may be implemented using a polarity switch (e.g., an XOR gate).

FIG. 2B is a block diagram illustrating an alternate implementation AF14 of FIR filter AF12. Feedback ANC filter AF20 may be implemented as an FIR filter according to the same principles discussed above with reference to FIG. 2A.

Figure 3:
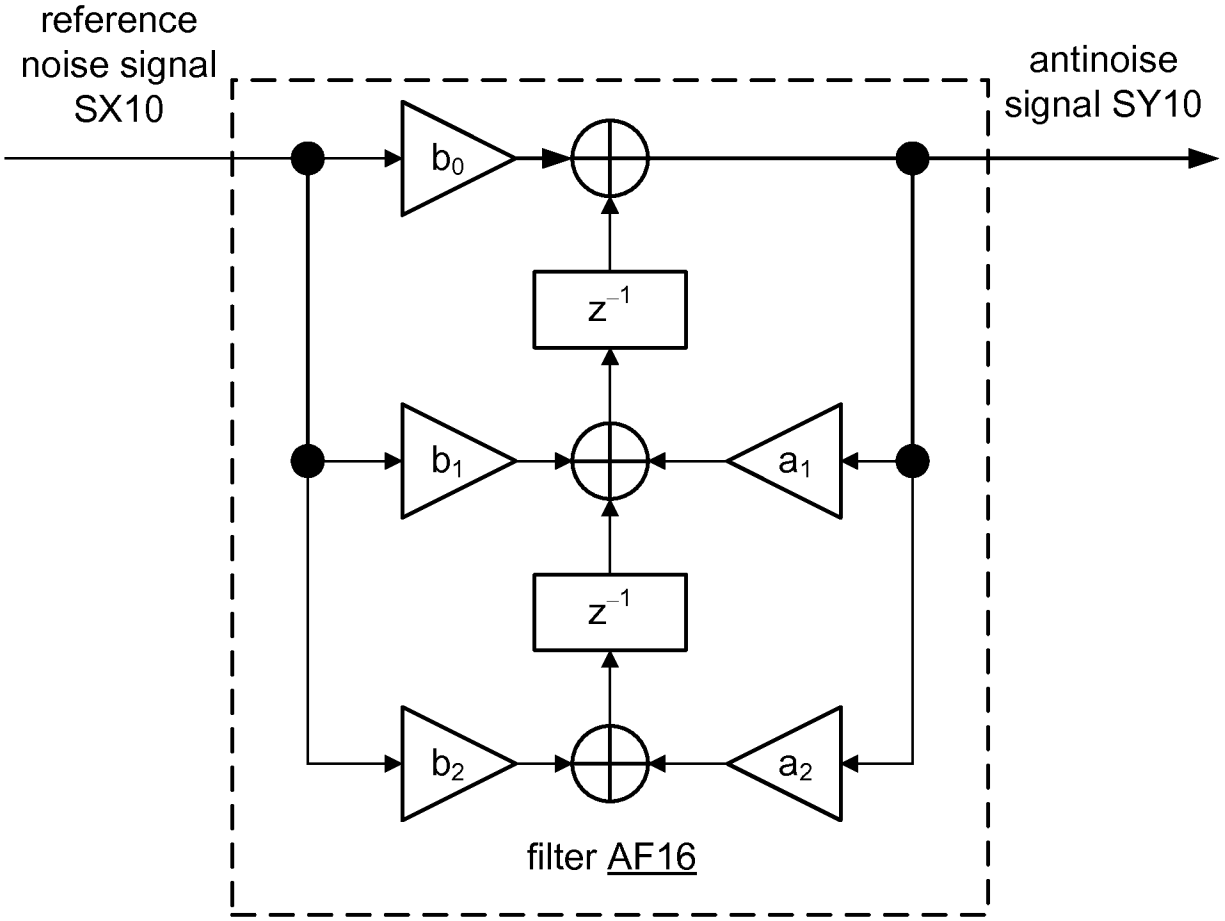
FIG. 3 is a block diagram illustrating an infinite-impulse-response (IIR) implementation of a filter.

FIG. 3 is a block diagram illustrating an infinite-impulse-response (IIR) implementation AF16 of filter AF10. In this example, filter AF16 has the transfer function $B(z)/(1-A(z))=(b_0+b_1*z^{-1}+b_2*z^{-2})/(1-a_1*z^{-1}-a_2*z^{-2})$ that is defined by the values of the filter coefficients (i.e., feedforward gain factors $b_0$, $b_1$, and $b_2$ and feedback gain factors $a_1$ and $a_2$). Although a second-order IIR filter is shown in this example, an IIR implementation of filter AF10 may include any number of filter stages (i.e., any number of filter coefficients) on either of the feedback side (i.e., the denominator of the transfer function) or the feedforward side (i.e., the numerator of the transfer function), depending on factors such as maximum allowable delay. For a case in which reference noise signal SX10 is one bit wide, each of the filter coefficients may be implemented using a polarity switch (e.g., an XOR gate).

Feedback ANC filter AF20 may be implemented as an IIR filter according to the same principles discussed above with reference to FIG. 3. Either of filters F10 and F20 may also be implemented as a series of two or more FIR and/or IIR filters.

Figure 4:
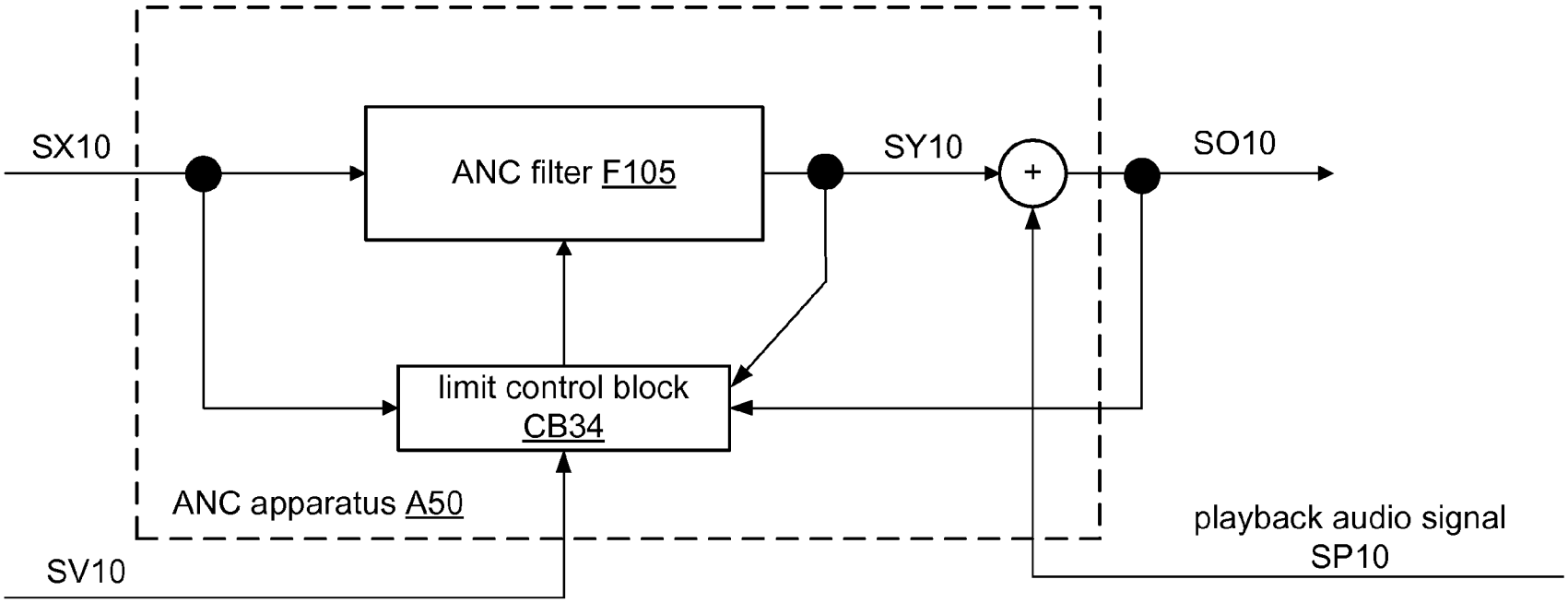
FIG. 4 is a block diagram illustrating of an ANC apparatus that may be configured to perform various aspects of the limited ANC output techniques described in this disclosure.

FIG. 4 is a block diagram illustrating of an ANC apparatus A50 that may be configured to perform various aspects of the limited ANC output techniques described in this disclosure. ANC apparatus A50 may represent one example of above described ANC apparatus A10 in that ANC apparatus A50 includes an ANC filter F105, which may be similar or substantially similar to ANC filter F10 of ANC apparatus A10. Although not shown in the example of FIG. 4, ANC apparatus A50 may include or otherwise be coupled to a loudspeaker similar to loudspeaker LS10 shown in the example of FIG. 1, and a reference microphone similar to reference microphone MR 10 also shown in the example of FIG. 1.

In the example of FIG. 4, ANC apparatus A50 also includes a limit control block CB34, which may represent a unit configured to perform various aspects of the techniques described in this disclosure. Limit control block CB34 may receive, retrieve or otherwise determine a reference noise audio signal SX10 obtained via a reference microphone, a voice audio signal SV10 obtained via a voice microphone (which may be different than the reference microphone), an active noise cancelled version of reference audio signal SX10 (which may be referred to as "active noise cancelled audio signal SY10") and a mixed output audio signal SO10 (which may represent an audio signal resulting from mixing active noise cancelled audio signal with playback audio signal SP10). Playback audio signal SP10 may represent an audio signal intended for playback via ANC apparatus A50 or some other device. Examples of playback audio signal SP10 represent so-called "desired" audio signals, such as music or other multimedia audio signals and voice audio signals. Playback audio signal SP10 may represent a "desired" audio signal in that the generally local noise-free quality of the audio signal (meaning that the playback audio signal SP10 may still have noise interjected purposefully, such as with music or multimedia audio signals, or not-locally, such as in a voice audio signal received from another communication device).

Limit control block CB34 may receive these signals SX10, SV10, SY10 and SO10 and first perform noise estimation with respect to one or more of the signals SX10, SV10, SY10 and SO10. While described as performing noise estimation, limit control block CB34 may, in some instances, not perform noise estimation, where such noise estimation is performed by a dedicated noise estimation block. In these instances, limit control block CB 34 may receive an estimated noise level from the noise estimation block, as described in further detail below. In any event, limit control block CB34 may perform noise estimation with respect to one or more of signals SX10, SV10, SY10 and SO10 to determine an estimated noise level. Reference to signals in this disclosure, such as signals SX10, SV10, SY10 and SO10 should be understood to refer to at least a portion of the signals and not necessarily the signal in its entirety.

Continuing, limit control block CB34 may measure loudness of one or more of signals SX10, SV10, SY10 and SO10 over some time period (e.g., usually a multiple of an audio frame duration) using approaches such as average amplitude, peak amplitude, average power or any combination thereof. For example, when performing noise estimation using average amplitude, limit control block CB34 may estimation the average amplitude by $\sqrt{(\Sigma X(t)^2)/N}$ or $(\Sigma|X(t)|)/N$, where X(t) represents a function of one or more signals SX10, SV10, SY10 and SO10 over time t, and N refers to the number of samples that form the signal X(t). Limit control block CB34 may estimate the noise level using peak power by computing MAX(|X(t)|), where the MAX(*) function returns a gain value for the sample of the noise signal X(t) having the maximum gain.

Next, limit control block CB34 may compare the estimated noise level to one or more threshold levels (which may also be referred to as "limits" in this disclosure). In some instances, limit control block CB34 may compare the estimated noise level to a single threshold level and, when the estimated noise level is greater than or equal to (or in some implementation is only greater than) the threshold level, dynamically adjust application of ANC filter F105 to reference audio signal SX10. In other words, limit control block CB 34 may dynamically adjust application of active noise cancellation to audio signal SX10 based on the estimated noise level. Limit controller block CB34 may perform this dynamic adjustment by adjusting a gain of ANC filter F105 (e.g., by specifying new filter coefficients for ANC filter F105 that result in less gain for ANC filter F105).

Figure 5:
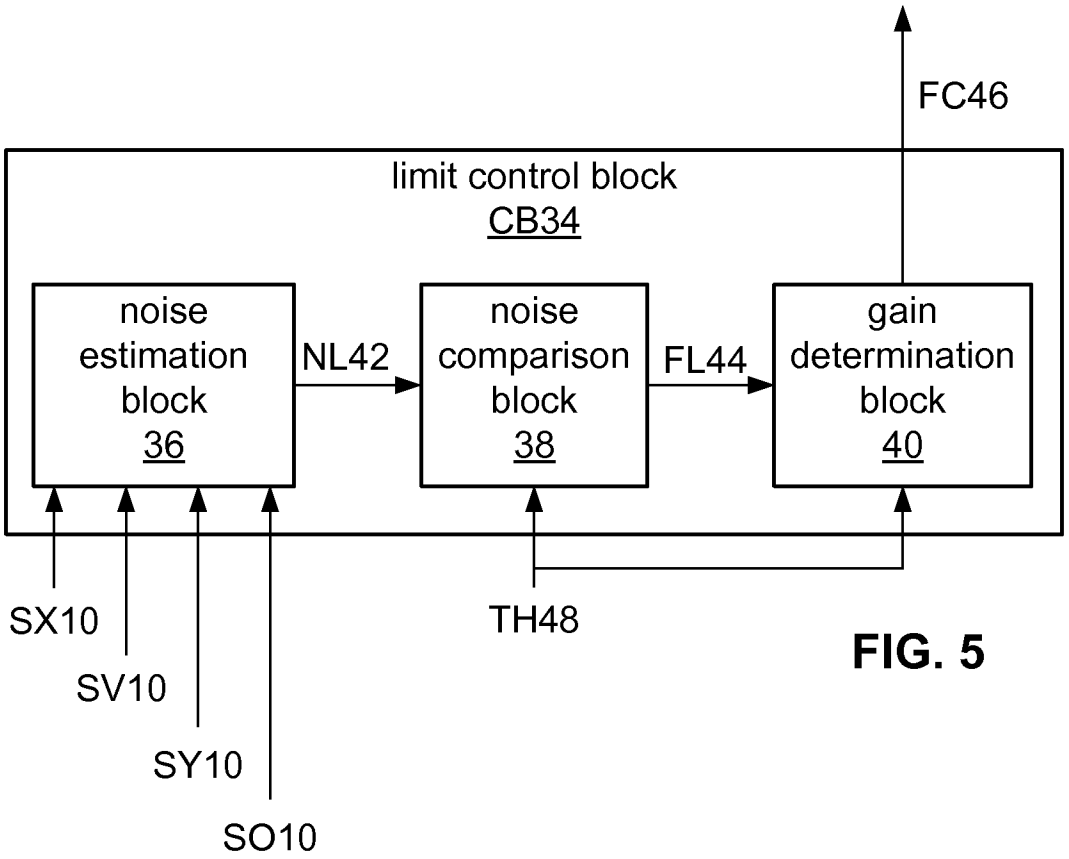
FIG. 5 is a block diagram illustrating the limit control block shown in the example of FIG. 4 in more detail.

FIG. 5 is a block diagram illustrating limit control block CB34 shown in the example of FIG. 4 in more detail. In the example of FIG. 5, limit control block CB34 includes a noise estimation block 36, a noise comparison block 38 and a gain determination block 40. Noise estimation block 36 may represent a unit configured to estimate a noise level from one or more of signals SX10, SV10, SY10 and SO10. Noise estimation block 36 may estimate the noise level using smoothing functions and/or filtering.

In some instances, noise estimation block 36 may use more than one noise estimation algorithm or model, where each noise estimation model may be configured to estimate different types of noise levels. For example, noise estimation block 36 may include an ambient noise estimation model to estimate a general ambient noise level. In this and other examples, noise estimation block 36 may also include a wind noise estimation model to estimate a particular type of noise, i.e., wind noise, which may require two or more of signals SX10, SV10, SY10 and SO10 to properly estimate the wind noise level. When employing two or more noise estimation algorithms, noise estimation block 36 may form estimated noise level NL42 as a function of the two or more intermediate estimated noise levels output by the two or more noise estimation algorithms. In any event, noise estimation block 36 may output estimated noise level NL42 to noise comparison block 38.

Noise comparison block 38 may represent a unit configured to compare estimated noise level NL42 to a threshold TH48. A user, manufacturer or developer may interface with a user interface presented by ANC apparatus A50 or another device to configure noise comparison block 38 with threshold TH48. In some instances, threshold TH48 may vary based on the type or source of audio signal to be played back (i.e., playback audio signal SP10 shown in the example of FIG. 4). In other words, for a voice call where playback audio signal SP10 represents a voice audio signal, noise comparison block 38 may be configured to compare estimated noise level NL42 to a threshold TH48 specific to voice audio signals, where this threshold TH48 may be higher than a threshold TH48 utilized when the user is attempting to listen to music audio signals. When estimated noise level NL42 equals or exceeds (or, in some instances, only exceeds) threshold TH48, noise comparison block 38 may output a flag FL44 to gain determination block 40, where this flag FL44 may indicate that gain determination block 40 is to reduce gain associated with ANC filter F105. In some instances, this flag FL44 may indicate that gain determination block 40 is to reduce the gain associated with ANC filter F105 to zero (which effectively disables application of ANC filter F105 to reference audio signal SX10). Whether noise comparison block 38 sends a flag FL44 to reduce or set to zero the gain associated with ANC filter F105 may be based on one or more of the type or source of playback audio signals SP10, estimated noise level NL42 or some other criteria or variable.

In some examples, noise comparison block 38 may utilize two or more thresholds TH48. In these and other examples, when estimated noise level NL42 is equal to or exceeds (or, in some instances, only exceeds) a first one of thresholds TH48, noise comparison block 38 may send a first flag FL40 indicating that gain determination block 40 is to reduce, but not disable, the gain associated with ANC filter F105. A second one of thresholds TH48 may be higher than the first one of thresholds TH48. When estimated noise level NL42 is equal to or exceeds (or, in some instances, only exceeds) the second one of thresholds TH48, noise comparison block 38 may output one of flags FL44 that indicates to gain determination block 40 that the gain associated with ANC filter F104 is to be reduced to zero. In this manner, noise comparison block 38 may send one or more flags FL44 to gain determination block 40 to indicate whether gain determination block 40 is to reduce or set to zero the gain associated with ANC filter F105.

Gain determination block 40 represents a unit that may compute a target gain for ANC filter F105 based on a comparison of estimated noise level NL42 to one or more thresholds TH 48 (where this comparison is effectively represented by the one or more of flags FL44). Gain determination block 40 may compute this target gain and then determine one or more filter coefficients FC46 that meet the target gain. Gain determination block 40 may then install these filter coefficients FC46 within ANC filter F105. In this manner, gain determination block 40 may effectively dynamically adjust application of ANC filter F105 to reference audio signal SX10 based on estimated noise level NL42.

Gain determination block 40 may be configured in some instances to incrementally reduce the gain over a given portion of time, e.g., over a series of X frames, where X may be a configurable number set by a user, manufacturer and/or developer. In some instances, the variable X may be configured to have different values depending on the source and/or type of playback audio signal SP10. For example, a user may play a video game that relies on ANC apparatus A50 to improve the experience by reducing or cancelling noise, where the application executing to present the video game may configure X to a number suitable for maintaining a consistent listening experience so as not to disrupt the user's gaming experience. In these and other examples, gain determination block 40 may reduce the gain by some percentage each frame of the X frames, generating filter coefficients FC46 and installing these filter coefficients FC 46 in ANC filter F105 prior to processing the next frame of the X frames.

Gain determination block 40 may, in these and other examples, also compute the target gain as a function of estimated noise level NL42 and threshold TH48. That is, gain determination block 40 may, in these and other examples, compute the target gain as a difference between estimated noise level NL42 and threshold TH48. In some examples, gain determination block 40 may compute the target gain as a function of estimated noise level NL42. In other words, gain determination block 40 may utilize one or more mathematical functions using estimated noise level NL42 as a variable in these one or more functions to compute the target gain. In some examples, gain determination block 40 may use estimated noise level NL42 as a key into a look-up table (LUT), which may return the target gain.

Noise estimation block 36 may continue to receive signals SX10, SV10, SY10 and SO10 and determine estimated noise level NL42. Noise estimation block 36 may output these recently updated estimated noise levels to noise comparison block 38, which may output one or more flags FL44 in the manner described above. Gain determination block 40 may then continue to dynamically (or, in other words, automatically) adjust application of ANC filter F105 based on these flags 44, thresholds 48 and/or estimated noise level 42.

Over time, the ambient noise, background noise, wind noise or other environmental noise may decrease in volume (e.g., a moving environmental noise, such as sirens on a moving vehicle) or cease entirely, at which point noise estimation block 36 may determine a recently updated estimated noise level 42 that is lower than thresholds TH48. When estimated noise level 42 is less than each of the one or more applicable thresholds TH48, noise comparison block 38 may output one or more flags FL44 indicating that gain determination block 40 is to return to a static form of ANC filter F105. Gain determination block 40 may store or otherwise maintain original filter coefficients FC 46 to be used when limiting application of ANC filter F105 is no longer desired or necessary. Gain determination block 40 may retrieve these filters coefficients FC46 and install these filter coefficients FC46 in ANC filter F105 to thereby dynamically readjust application of ANC filter F105 to its originally configured state.

In this way, the techniques may enable limit controller block CB34 of ANC apparatus A50 to dynamically adjust, based on an estimated noise level, application of active noise cancellation to at least a portion of an audio signal to obtain at least a portion of an active noise cancelled version of the audio signal.

In these and other examples, limit controller block CB34 may, when dynamically adjusting the application of the active noise cancellation, dynamically adjust, based on the estimated noise level, application of non-adaptive active noise cancellation to at least the portion of the audio signal to obtain at least the portion of the active noise cancelled version of the audio signal.

In these and other examples, limit controller block CB34 may, when dynamically adjusting the application of the active noise cancellation, dynamically lower a gain of at least the portion of the audio signal based on the estimated noise level.

In these and other examples, limit controller block CB34 may, when dynamically adjusting the application of the active noise cancellation, dynamically set a gain of at least the portion of the audio signal to be zero based on the estimated noise level.

In these and other examples, limit controller block CB34 may, when dynamically adjusting the application of the active noise cancellation, dynamically adjust, based on the estimated noise level, a gain of an active noise cancellation filter to be applied to at least a portion of a reference noise audio signal so as to output the active noise cancelled version of at least the portion of the audio signal.

In these and other examples, limit controller block CB34 may, when dynamically adjusting the application of the active noise cancellation, dynamically adjust, based on a difference between the estimated noise level and a threshold level, a gain of an active noise cancellation filter to be applied to at least a portion of a reference noise audio signal so as to output at least the portion of the active noise cancelled version of the audio signal.

In these and other examples, limit controller block CB34 may, when dynamically adjusting the application of the active noise cancellation, dynamically adjust, based on a mathematical function of the estimated noise level, a gain of an active noise cancellation filter to be applied to at least a portion of the audio signal so as to output at least the portion of the active noise cancelled version of the audio signal.

In these and other examples, limit controller block CB34 may, when dynamically adjusting the application of the active noise cancellation, dynamically adjust a gain of an active noise cancellation filter to be equivalent to a gain determined using the estimated noise level as a key into a look-up table, the active noise cancellation filter to be applied to at least the portion of the audio signal so as to output at least the portion of the active noise cancelled version of the audio signal.

In these and other examples, limit controller block CB34 may, when dynamically adjusting the application of the active noise cancellation, dynamically set, based on the estimated noise level, a gain of an active noise cancellation filter to be zero prior to applying the active noise cancellation filter to at least the portion of the audio signal so as to output at least the portion of the active noise cancelled version of the audio signal.

In these and other examples, limit controller block CB34 may, when dynamically adjusting the application of the active noise cancellation, compare the estimated noise level to a threshold level. In these examples, when the estimated noise level is greater than or equal to the threshold level, limit controller block CB34 dynamically adjust a gain of an active noise cancellation filter to be applied to at least the portion of the audio signal so as to output at least the portion of the active noise cancelled version of the audio signal.

In these and other examples, limit controller block CB34 may, when the estimated noise level is greater than or equal to a threshold level, dynamically adjust a gain of at least an active noise cancellation filter to be applied to a first portion of the audio signal so as to output a first portion of the active noise cancelled version of the audio signal, set a counter to a value greater than one, and decrease the value of the counter by one. When the value of the counter is equal to zero, limit controller block CB34 may determine whether a recently updated estimate noise level exceeds the threshold level. When the recently updated estimate noise level exceeds the threshold value, limit controller block CB34 dynamically adjusts the gain of the active noise cancellation filter to be applied to a second portion of the audio signal so as to output a second portion of the active noise cancelled version of the audio signal, resetting the counter to the value greater than one, and decreasing the value of the counter by one.

In these and other examples, limit controller block CB34 may, when the estimated noise level is greater than or equal to a threshold level, dynamically adjust a gain of an active noise cancellation filter to be applied to at least a first portion of the audio signal so as to output a first portion of the active noise cancelled version of the audio signal, set a counter to a value greater than one, and decrease the value of the counter by one. When the value of the counter is equal to zero, limit controller block CB34 may determine whether a recently updated estimate noise level exceeds the threshold level, and when the recently updated estimate noise level is less than the threshold value, dynamically reset the gain of the active noise cancellation filter to a value of the gain used prior to dynamically adjusting the gain.

In these and other examples, limit controller block CB34 may, when the estimated noise level is greater than or equal to a first threshold level, enable the dynamic adjustment of at least the portion of the audio signal. In these and other examples, limit controller block CB34 may, when the estimated noise level is greater than or equal to a second threshold level, dynamically adjust a gain of an active noise cancellation filter to be applied to at least a portion of the audio signal so as to output at least the portion of the active noise cancelled version of the audio signal.

In these and other examples, limit controller block CB34 may perform noise estimation with respect to a reference noise audio signal to obtain the estimated noise level.

In these and other examples, limit controller block CB34 may, when performing the noise estimation, determine the estimated noise level as an average amplitude of at least a portion of a reference noise audio signal.

In these and other examples, limit controller block CB34 may, when performing the noise estimation, determine the estimated noise level as a peak amplitude of at least a portion of a reference noise audio signal.

In these and other examples, limit controller block CB34 may, when performing the noise estimation, determine the estimated noise level as an average power of at least a portion of a reference noise audio signal.

In these and other examples, limit controller block CB34 may, when performing the noise estimation, perform a non-wind noise estimation with respect to the reference noise audio signal to obtain the estimated noise level.

In these and other examples, limit controller block CB34 may, when performing the noise estimation, perform a wind noise estimation with respect to the reference noise audio signal to obtain the estimated noise level.

In these and other examples, limit controller block CB34 may, when performing the noise estimation, perform a non-wind noise estimation with respect to the reference noise audio signal to obtain a first estimated noise level, perform a wind noise estimation with respect to the reference noise audio signal to obtain a second estimated noise level, and determine the estimated noise level as a function of the first estimated noise level and the second estimated noise level.

In these and other examples, limit controller block CB34 may, when performing the noise estimation, perform the noise estimation with respect to at least a portion of a voice audio signal obtained using a voice microphone.

In these and other examples, limit controller block CB34 may, when performing the noise estimation, perform the noise estimation with respect to at least a portion of a reference noise audio signal obtained using a reference microphone different from a voice microphone.

In these and other examples, limit controller block CB34 may, when performing the noise estimation, perform the noise estimation with respect to at least a portion of a reference noise audio signal obtained using a reference microphone and at least a portion of a voice audio signal obtained using a voice microphone to determine the estimated noise level.

In these and other examples, limit controller block CB34 may, when performing the noise estimation, perform the noise estimation with respect to a mix of at least the portion of the active noise cancelled version of the audio signal mixed with a playback audio signal.

In some examples, the playback audio signal comprises a music audio signal. In other examples, the playback audio signal comprises a voice audio signal. In still other examples, the playback audio signal comprises a multimedia audio signal.

In various instances, one or more of the above described examples may be performed with respect to one another. In other words, reference to these and other examples above may be understood to mean that these examples, while described as separate examples, may be performed in any reasonable combination. The techniques should therefore not be limited in this respect.

Figure 6A:
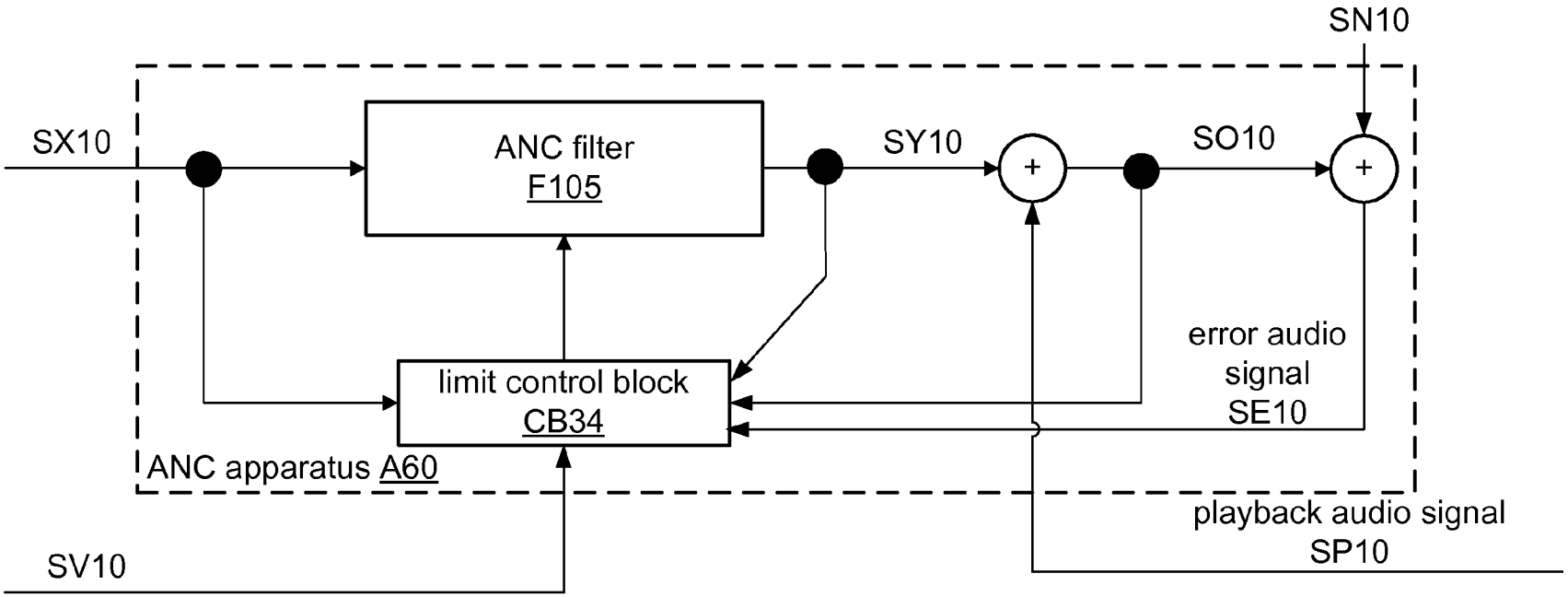
FIGS. 6A-6C are block diagrams illustrating ANC apparatuses that perform adaptive ANC (AANC) that may be limited or otherwise adjusted in accordance with various aspects of the techniques described in this disclosure.
Figure 6B:
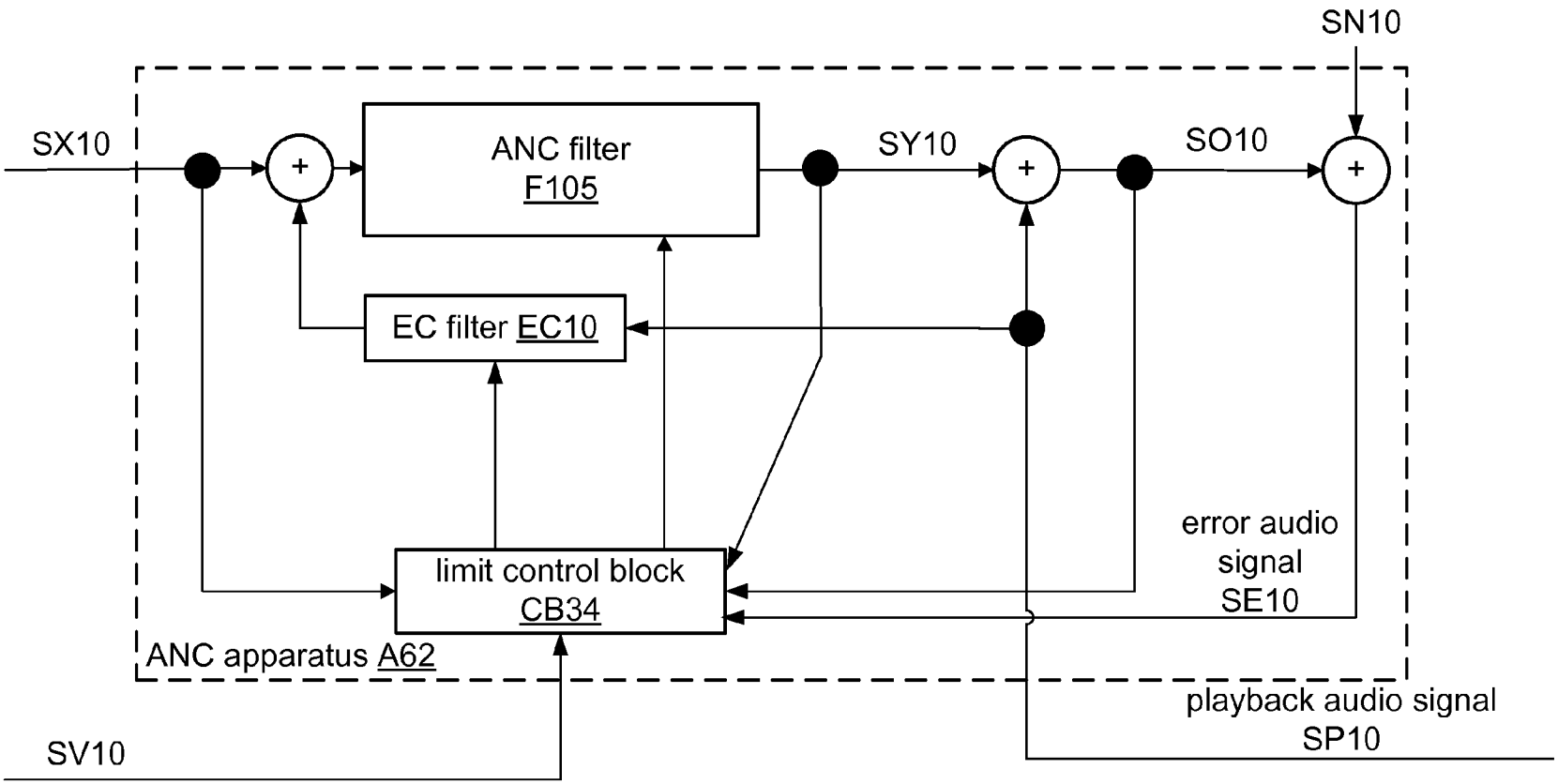
Figure 6C:
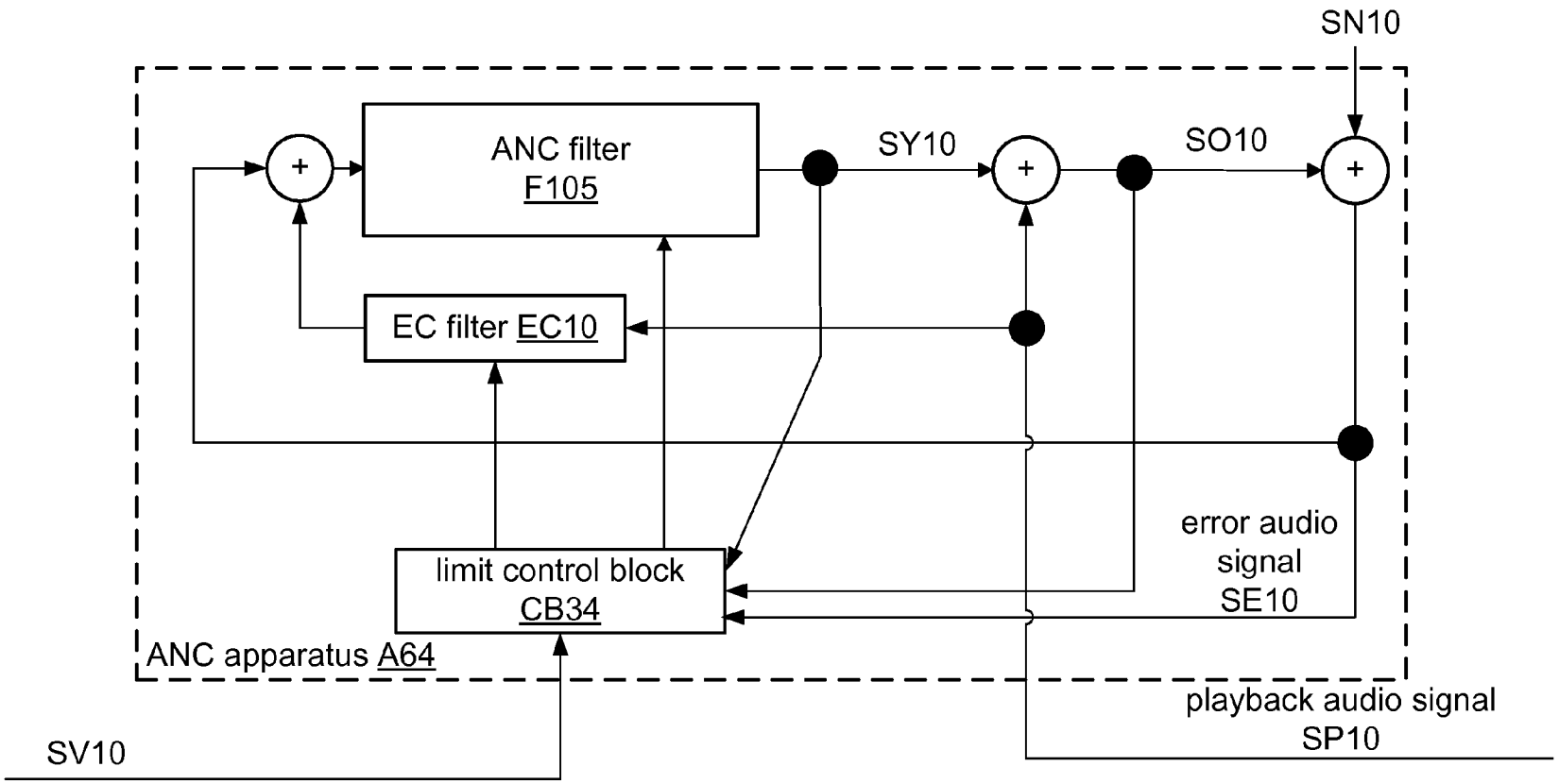

FIGS. 6A-6C are block diagrams illustrating ANC apparatuses A60 and A62 that perform adaptive ANC (AANC) that may be limited or otherwise adjusted in accordance with various aspects of the techniques described in this disclosure. ANC apparatus A60 shown in the example of FIG. 6A may represent another variation of apparatus A20 and may be similar to ANC apparatus A50. While similar to ANC apparatus A50, ANC apparatus A60 may receive an additional noise audio signal SN10 detected or otherwise obtained by an error microphone, such as error microphone ME10 shown in the example of FIG. 1B. As shown in the example of FIG. 1B, error microphone ME10 may be proximate spatially to loudspeaker LS10 to sample or otherwise obtain a representation of the sound emitted by loudspeaker LS10 in the form of noise audio signal SN10.

As shown in the example of FIG. 6A, limit control block CB 34 may receive additional audio signal SE 10, which may represent an error audio signal SE 10 that ANC apparatus A60 computes as a function of output audio signal SO10 and noise audio signal SN10. That is, ANC apparatus A60 may compute error audio signal SE10 as a difference between output audio signal SO10 and noise audio signal SN10 (for the same or nearly the same time period, which may involve buffering output audio signal SO10). Limit control block CB34 may utilize error audio signal SE10 when performing noise estimation, as described below with respect to FIG. 7.

FIG. 6B is a block diagram illustrating ANC apparatus A62 that performs adaptive ANC (AANC) that may be limited or otherwise adjusted in accordance with various aspects of the techniques described in this disclosure. ANC apparatus A62 may be substantially similar to ANC apparatus A60, except that ANC apparatus A62 includes an additional echo cancellation (EC) filter EC10. EC filter EC 10 may perform echo cancellation filtration with respect to playback audio signal SP10. Echo cancellation filter EC 10 may perform any form of echo cancellation, including one or more of acoustic echo cancellation (AEC), acoustic echo suppression (AES) and line echo cancellation (LEC). Echo cancellation filter EC10 may output the echo cancelled audio signal, which is then summed with reference audio signal SX10 prior to being input to ANC filter F105.

EC filter EC10 may, in some embodiments, be controlled via configuration data specified by limit control block CB34. For example, limit control block CB34 may turn on or off echo cancellation filter based on one or more of audio signal SE10, SO10 and SY10 or analysis thereof. When turned off, EC filter EC10 may, as one example, pass playback audio signal SP10 through to the summation prior to ANC filter F105. In another example, EC filter EC10 may not, when turned off, pass through playback audio signal SP10 but instead may output a null signal. In other examples, limit control block CB34 may provide configuration data to configure EC filter EC10 so as to limit or otherwise attenuate application of EC filter EC10 to playback audio signal SP10, where again such configuration may be generated based on one or more of audio signal SE10, SO10 and SY10 or analysis thereof.

FIG. 6C is a block diagram illustrating ANC apparatus A64 that performs adaptive ANC (AANC) that may be limited or otherwise adjusted in accordance with various aspects of the techniques described in this disclosure. ANC apparatus A64 may be substantially similar to ANC apparatus A62, except that ANC apparatus A64 sums the error audio signal SE10 with the output of EC filter EC10. As described above, EC filter EC10 may perform echo cancellation filtration with respect to playback audio signal SP10. Echo cancellation filter EC10 may perform any form of echo cancellation, including one or more of acoustic echo cancellation (AEC), acoustic echo suppression (AES) and line echo cancellation (LEC). Echo cancellation filter EC10 may output the echo cancelled audio signal, which is then summed with error audio signal SE10 prior to being input to ANC filter F105.

The ANC limiting techniques may, in this way, be performed with respect to ANC that also incorporates an echo cancellation filter, such as EC filter EC10. In other words, ANC apparatuses A62 and A64 may represent an apparatus configured to perform echo cancellation with respect to the audio signal to obtain an echo cancelled audio signal, and apply the active noise cancellation to at least the portion of the echo cancelled audio signal.

Figure 7:
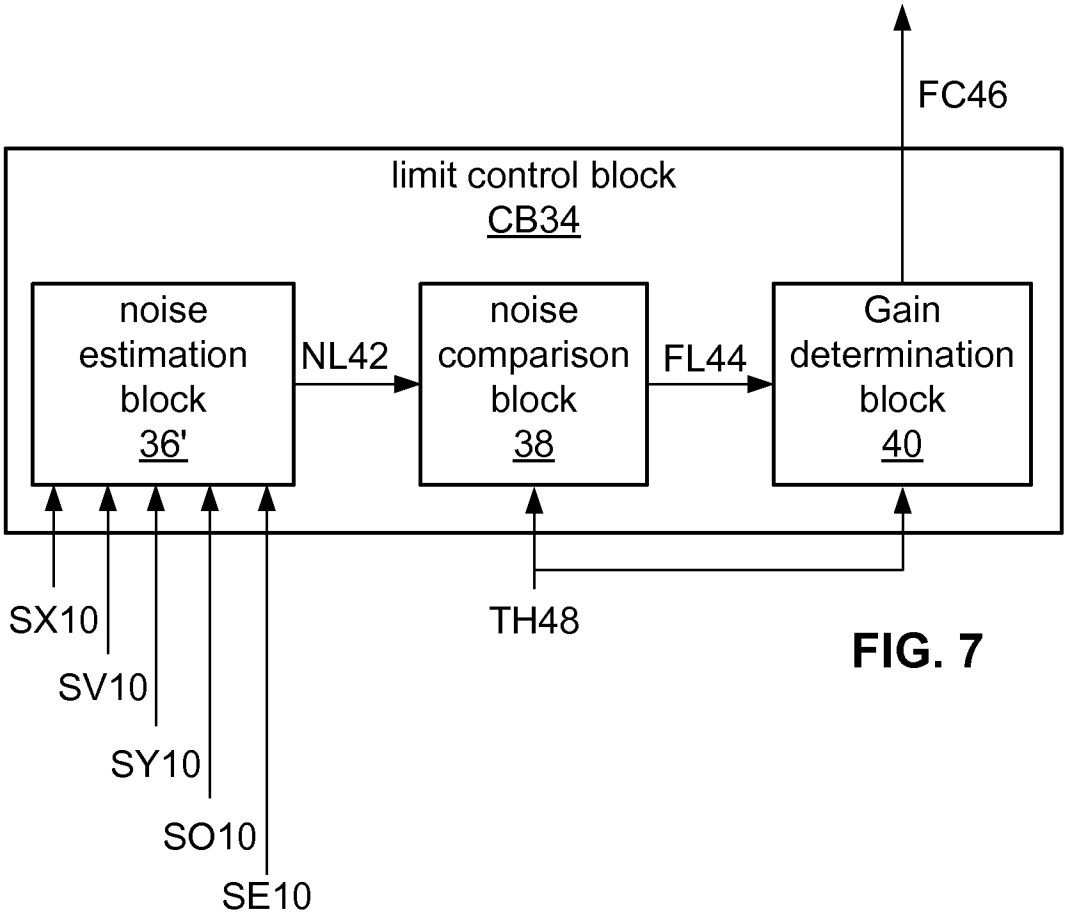
FIG. 7 is a block diagram illustrating another variation of limit control block that performs noise estimation with respect to error audio signal among other signals in accordance with various aspects of the techniques described in this disclosure.

FIG. 7 is a block diagram illustrating another variation of limit control block CB34 that performs noise estimation with respect to error audio signal SE10 among other signals. Limit control bock CB34 shown in the example of FIG. 7 may be substantially similar to limit control block CB34 shown in the example of FIG. 5, except that noise estimation block 36 receives error audio signal SE10 in addition potentially to one or more of audio signals SX10, SV10, SY10 and SO10. This variation of noise estimation block 36 may be denoted as "noise estimation block 36'." Noise estimation block 36' may, in some instances, compute estimated noise level NL42 based on error audio signal SE10. Both noise comparison block 38 and gain determination block 40 may operate in substantially the same manner as that described above with respect to limit control block CB34 shown in the example of FIG. 5.

In addition to the various aspects of the techniques described above with respect to limit controller block CB34 of ANC apparatus A50, the techniques may enable limit controller block CB34 of ANC apparatus A60 to, when dynamically adjusting the application of the active noise cancellation, dynamically adjusting, based on the estimated noise level, application of adaptive active noise cancellation to at least the portion of the audio signal to obtain at least the portion of the active noise cancelled version of the audio signal.

In these and other examples, limit controller block CB34 may, when performing the noise estimation, perform the noise estimation with respect to a function of at least a portion of a reference noise audio signal obtained using a reference microphone and at least a portion of an error audio signal, at least the portion of the error audio signal computed as a difference between at least the portion of the noise audio signal obtained using an error microphone and at least the portion of the active noise cancelled version of the audio signal.

Figure 8A:
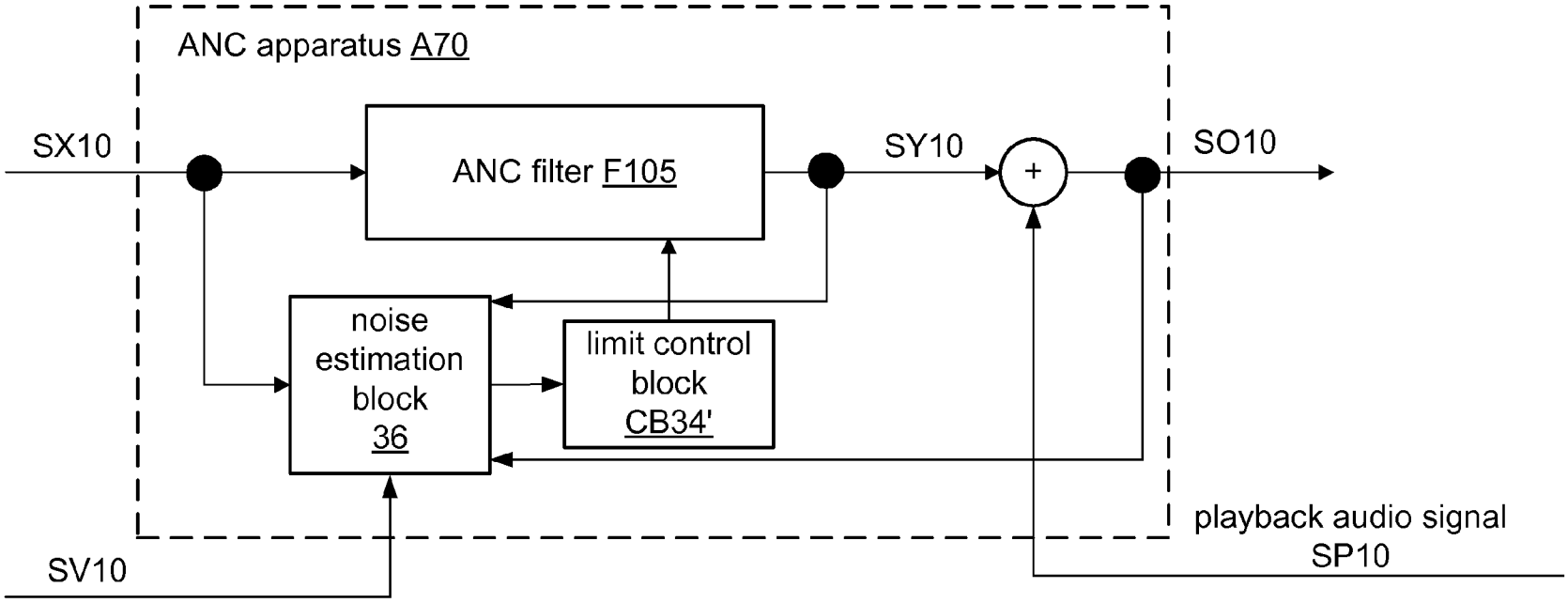
FIGS. 8A-8C are a block diagram illustrating example ANC apparatuses that perform ANC that may be limited or otherwise adjusted in accordance with various aspects of the techniques described in this disclosure.
Figure 8B:
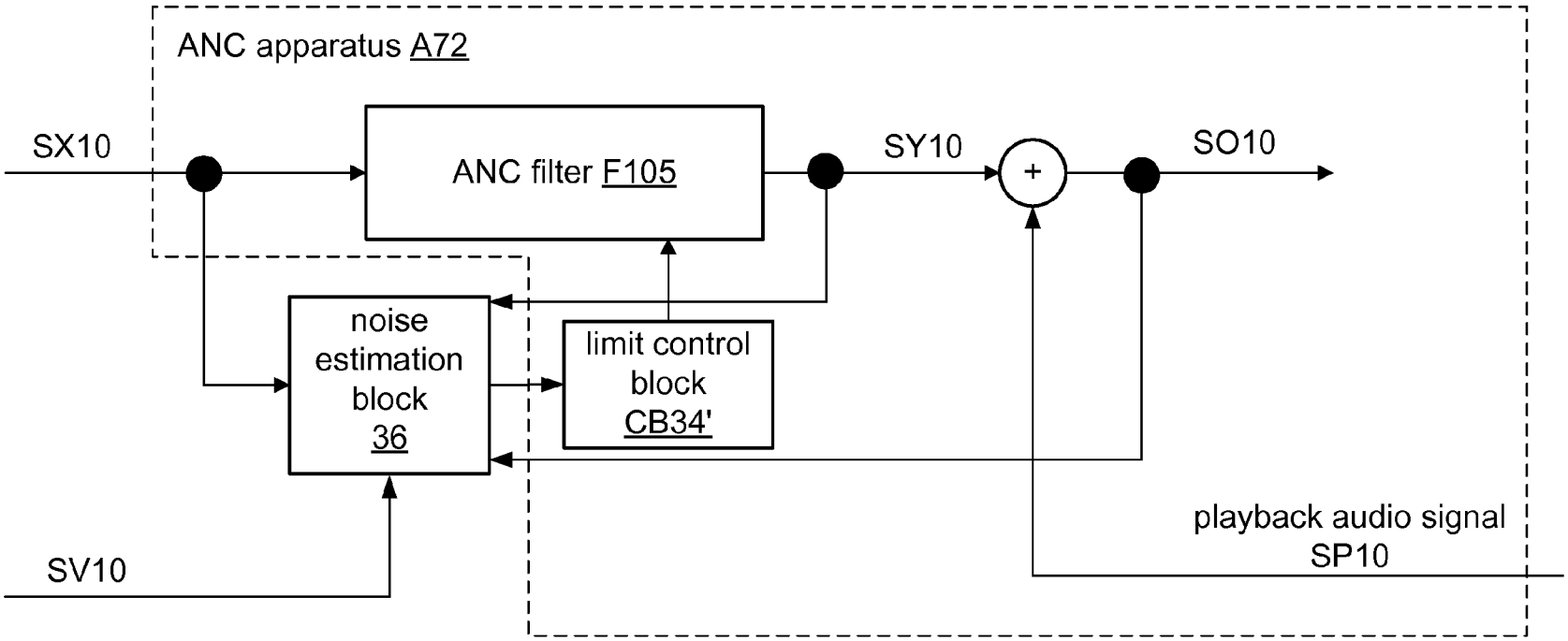
Figure 8C:
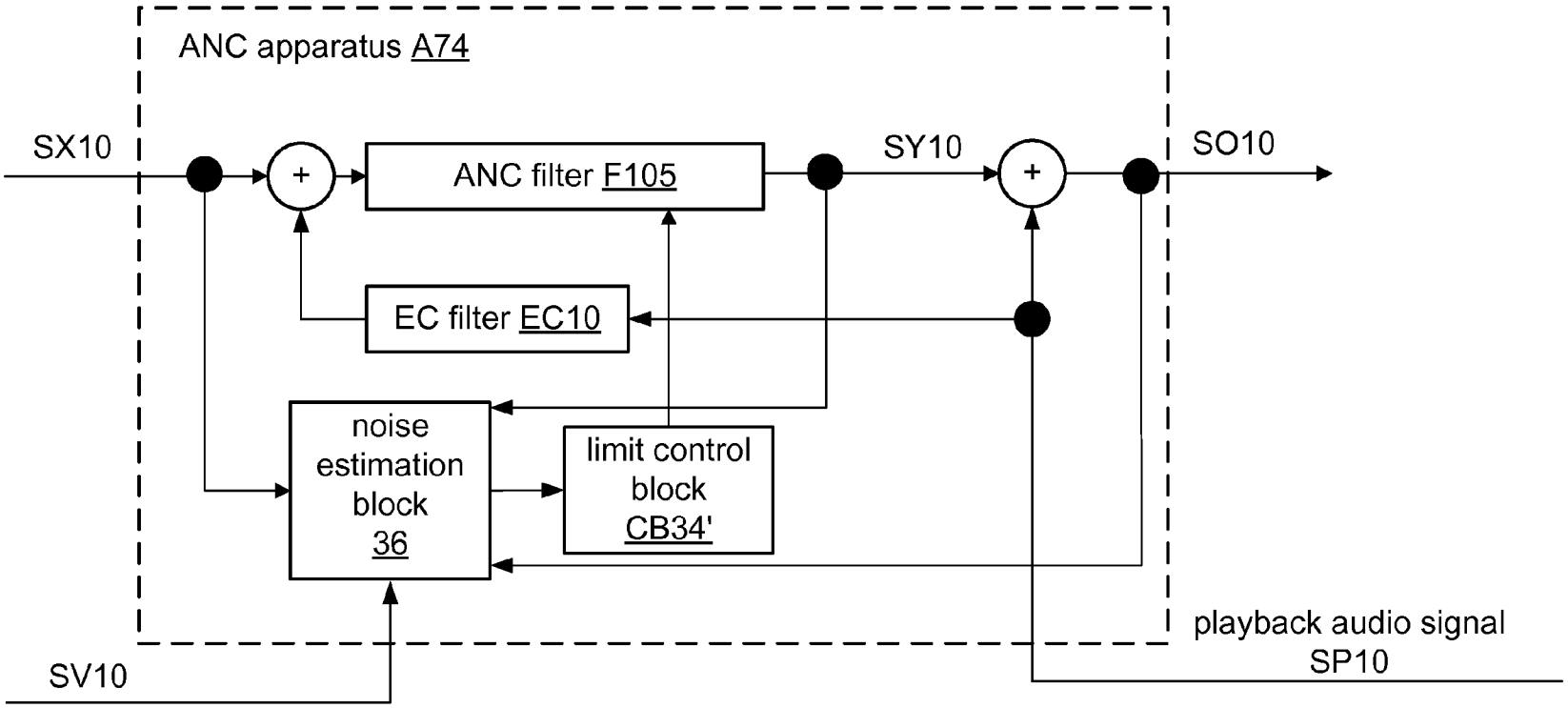

FIGS. 8A-8C are a block diagram illustrating example ANC apparatuses A70-A76 that perform ANC that may be limited or otherwise adjusted in accordance with various aspects of the techniques described in this disclosure. ANC apparatus A70 shown in the example of FIG. 8A may be substantially similar to ANC apparatus A50, except that noise estimation block 36 is separate from limit control block CB34 (where this limit control block is denoted as limit control block CB34'). In some examples, noise estimation block 36 may not be included within ANC apparatus A70 but may be included within a different block, unit, module, device or apparatus. Noise estimation block 36 may determine estimated noise level NL42 in the manner described above, outputting this estimated noise level NL42 to limit control block CB34', which may operate substantially similar to limit control block CB34 described above with respect to the example of FIGS. 4 and 5, except that limit control block CB 34' does not perform noise estimation.

FIG. 8B is a block diagram illustrating an example ANC apparatus A72 that performs ANC that may be limited or otherwise adjusted in accordance with various aspects of the techniques described in this disclosure. ANC apparatus A72 may be substantially similar to ANC apparatus A70, except that ANC apparatus A72 does not include noise estimation block 36. In the example of FIG. 8B, another device, apparatus or unit (possibly within the same device as ANC apparatus A72) may include noise estimation block 36, which may perform the operations described above in more detail to provide noise estimation.

FIG. 8C is a block diagram illustrating an example ANC apparatus A74 that performs ANC that may be limited or otherwise adjusted in accordance with various aspects of the techniques described in this disclose. ANC apparatus A74 may be substantially similar to ANC apparatus A70, except that ANC apparatus A74 includes an additional echo cancellation (EC) filter EC10. EC filter EC 10 may perform echo cancellation filtration with respect to playback audio signal SP10. Echo cancellation filter EC10 may perform any form of echo cancellation, including one or more of acoustic echo cancellation (AEC), acoustic echo suppression (AES) and line echo cancellation (LEC). Echo cancellation filter EC10 may output the echo cancelled audio signal, which is then summed with reference audio signal SX10 prior to being input to ANC filter F105. In this respect, ANC apparatuses A74 may represent an apparatus configured to perform echo cancellation with respect to the audio signal to obtain an echo cancelled audio signal, and apply the active noise cancellation to at least the portion of the echo cancelled audio signal.

Figure 9:
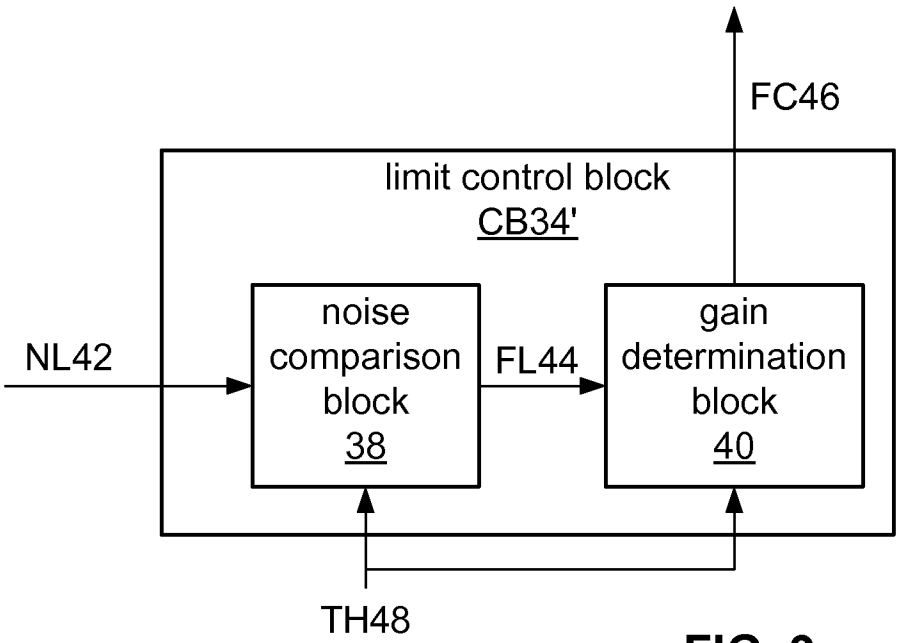
FIG. 9 is a diagram illustrating limit control block CB34' of the example of FIG. 8 in more detail.

FIG. 9 is a diagram illustrating limit control block CB34' of the example of FIG. 7 in more detail. Limit control block CB34' is substantially similar to limit control block CB34' shown in the example of FIG. 5, except that limit control block CB34' does not include noise estimation block 36. Instead, noise comparison block 38 of limit control block CB 34' receives estimated noise level NL42 and operates in the manner described above to output one or more of flags FL44 to gain determination block 40. Gain determination block 40 also operates in substantially the same manner as that described above with respect to FIG. 5 to output filter coefficients FC46 that effectively adjust application of ANC filter F105 to reference audio signal SX10.

Figure 10:
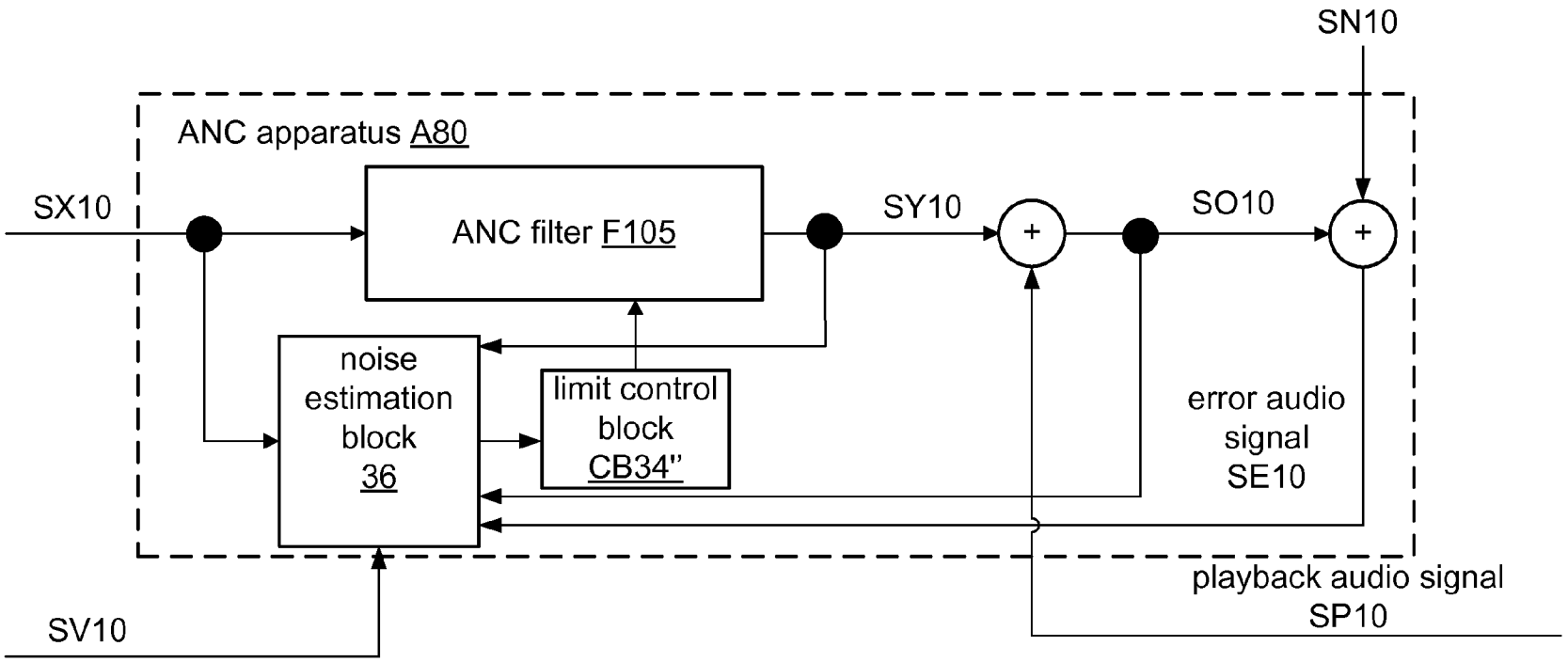
FIG. 10 is a block diagram illustrating another example ANC apparatus that performs ANC that may be limited or otherwise adjusted in accordance with various aspects of the techniques described in this disclosure.

FIG. 10 is a block diagram illustrating another example ANC apparatus A80 that performs ANC that may be limited or otherwise adjusted in accordance with various aspects of the techniques described in this disclosure. ANC apparatus A80 may be substantially similar to ANC apparatus A60, except that noise estimation block 36 is separate from limit control block CB34 (where this limit control block is denoted as limit control block CB34"). In some examples, noise estimation block 36 may not be included within ANC apparatus A80 but may be included within a different block, unit, module, device or apparatus. Noise estimation block 36 may determine estimated noise level NL42 in the manner described above, outputting this estimated noise level NL42 to limit control block CB34", which may operate substantially similar to limit control block CB34 described above with respect to the example of FIGS. 6 and 7, except that limit control block CB 34" does not perform noise estimation.

Figure 11:
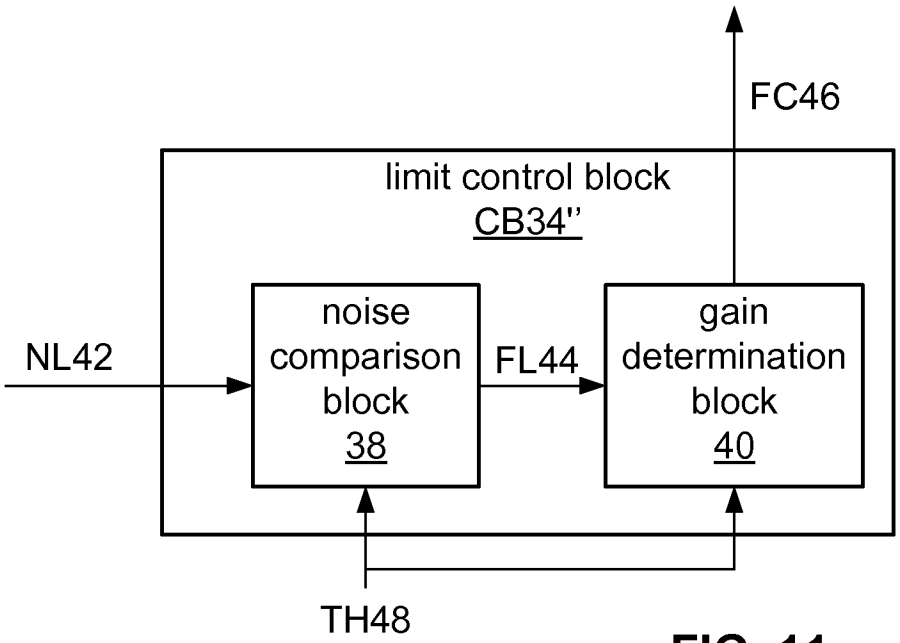
FIG. 11 is a diagram illustrating the limit control block of the example of FIG. 9 in more detail.

FIG. 11 is a diagram illustrating limit control block CB34" of the example of FIG. 9 in more detail. Limit control block CB34" is substantially similar to limit control block CB34 shown in the example of FIG. 7, except that limit control block CB34" does not include noise estimation block 36. Instead, noise comparison block 38 of limit control block CB 34" receives estimated noise level NL42 and operates in the manner described above to output one or more of flags FL44 to gain determination block 40. Gain determination block 40 also operates in substantially the same manner as that described above with respect to FIG. 7 to output filter coefficients FC46 that effectively adjust application of ANC filter F105 to reference audio signal SX10.

Figure 12:
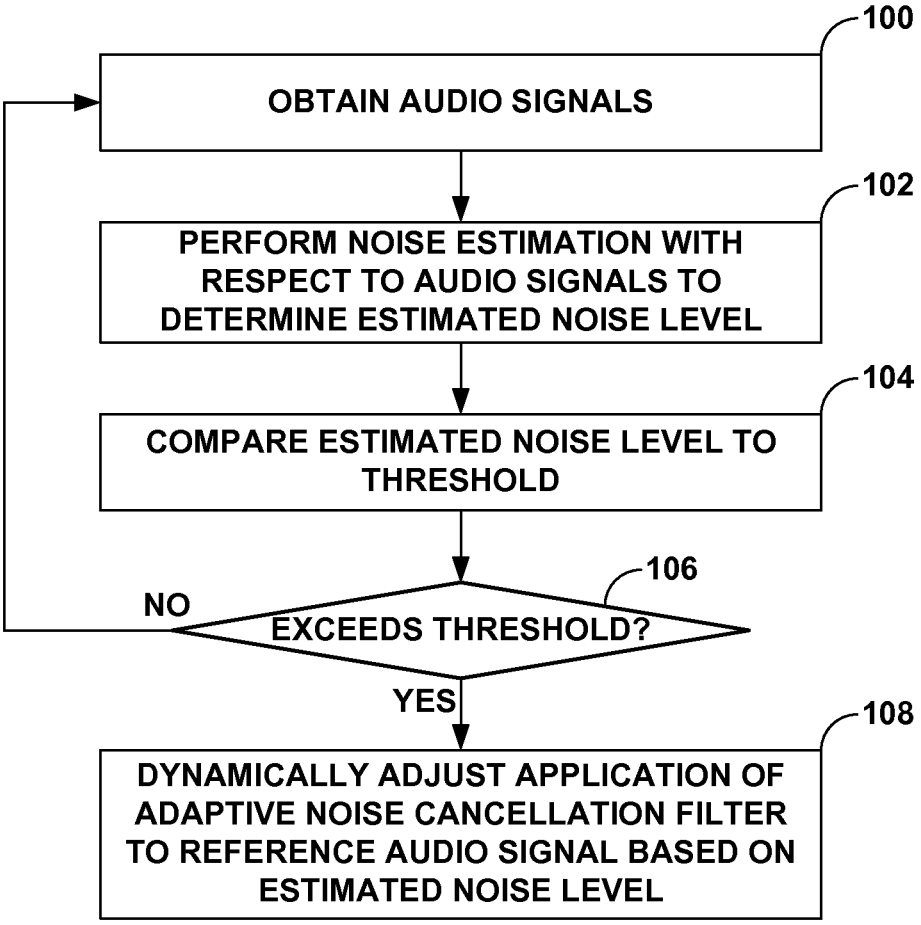
FIG. 12 is a flowchart illustrating exemplary operation of an ANC apparatus configured to perform various aspects of the techniques described in this disclosure.

FIG. 12 is a flowchart illustrating exemplary operation of an ANC apparatus, such as ANC apparatus A50 shown in the example of FIG. 4, configured to perform various aspects of the techniques described in this disclosure. Initially, limit control block CB34 of ANC apparatus A50 may receive, retrieve or otherwise obtain a reference noise audio signal SX10 obtained via a reference microphone, a voice audio signal SV10 obtained via a voice microphone (which may be different than the reference microphone), an active noise cancelled version of reference audio signal SX10 (which may be referred to as "active noise cancelled audio signal SY10") and a mixed output audio signal SO10 (which may represent an audio signal resulting from mixing active noise cancelled audio signal with playback audio signal SP10) (100).

Limit control block CB34 may receive these signals SX10, SV10, SY10 and SO10 and first perform noise estimation with respect to one or more of the signals SX10, SV10, SY10 and SO10 to determine an estimated noise level (102). Limit control block CB34 may measure loudness of one or more of signals SX10, SV10, SY10 and SO10 over some time period (e.g., usually a multiple of an audio frame duration) using approaches such as average amplitude, peak amplitude, average power or any combination thereof. Next, limit control block CB34 may compare the estimated noise level to one or more threshold levels (104).

When the estimated noise level is greater than or equal to (or in some implementation is only greater than or exceeds) the threshold ("YES" 106), limit control block CB34 may dynamically adjust application of ANC filter F105 to reference audio signal SX10. In other words, limit control block CB 34 may dynamically adjust application of active noise cancellation to audio signal SX10 based on the estimated noise level (108). Limit controller block CB34 may perform this dynamic adjustment by adjusting a gain of ANC filter F105 (e.g., by specifying new filter coefficients for ANC filter F105 that result in less gain for ANC filter F105). When the estimated noise level does not exceed the threshold ("NO" 106), limit control block CB34 may continue to obtain the audio signals, perform noise estimation and compare the estimated noise level to the threshold (100-106).

The foregoing techniques may, in this respect, enable an apparatus having means (e.g., one or more processors and/or a memory) to perform the operations set forth in the following clauses:

Clause 1. An apparatus comprising:

means for storing an audio signal; and means for, when an estimated noise level increases, dynamically lowering application of active noise cancellation to at least a portion of the audio signal to obtain at least a portion of an active noise cancelled version of the audio signal.

Clause 2. The apparatus of clause 1, wherein the means for dynamically lowering the application of the active noise cancellation comprises means for, when the estimated noise level increases, dynamically lowering application of non-adaptive active noise cancellation to at least the portion of the audio signal to obtain at least the portion of the active noise cancelled version of the audio signal.

Clause 3. The apparatus of clause 1, wherein the means for dynamically lowering the application of the active noise cancellation comprises means for, when the estimated noise level increases, dynamically lowering application of adaptive active noise cancellation to at least the portion of the audio signal to obtain at least the portion of the active noise cancelled version of the audio signal.

Clause 4. The apparatus of clause 1, wherein the means for dynamically lowering the application of the active noise cancellation comprises means for, when the estimated noise level increases, dynamically lowering a gain of at least the portion of the audio signal based on the estimated noise level.

Clause 5. The apparatus of clause 1, wherein the means for dynamically lowering the application of the active noise cancellation comprises means for, when the estimated noise level increases, dynamically setting a gain of at least the portion of the audio signal to be zero based on the estimated noise level.

Clause 6. The apparatus of clause 1, wherein the means for dynamically lowering the application of the active noise cancellation comprises means for, when the estimated noise level increases, dynamically lowering a gain of an active noise cancellation filter to be applied to at least a portion of a reference noise audio signal so as to output the active noise cancelled version of at least the portion of the audio signal.

Clause 7. The apparatus of clause 1, wherein the means for dynamically lowering the application of the active noise cancellation comprises means for, when the estimated noise level increases above a threshold level, dynamically lowering a gain of an active noise cancellation filter to be applied to at least a portion of a reference noise audio signal so as to output at least the portion of the active noise cancelled version of the audio signal.

Clause 8. The apparatus of clause 1, wherein the means for dynamically lowering the application of the active noise cancellation comprises means for dynamically lowering, based on a mathematical function of the estimated noise level, a gain of an active noise cancellation filter to be applied to at least a portion of the audio signal so as to output at least the portion of the active noise cancelled version of the audio signal.

Clause 9. The apparatus of clause 1, wherein the means for dynamically lowering the application of the active noise cancellation comprises means for dynamically lowering a gain of an active noise cancellation filter to be equivalent to a gain determined using the estimated noise level as a key into a look-up table, the active noise cancellation filter to be applied to at least the portion of the audio signal so as to output at least the portion of the active noise cancelled version of the audio signal.

Clause 10. The apparatus of clause 1, wherein the means for dynamically lowering the application of the active noise cancellation comprises means for dynamically setting, based on the estimated noise level, a gain of an active noise cancellation filter to be zero prior to applying the active noise cancellation filter to at least the portion of the audio signal so as to output at least the portion of the active noise cancelled version of the audio signal.

Clause 11. The apparatus of clause 1, wherein the means for dynamically lowering the application of the active noise cancellation comprises:

means for comparing the estimated noise level to a threshold level; and means for, when the estimated noise level is greater than or equal to the threshold level, dynamically adjusting a gain of an active noise cancellation filter to be applied to at least the portion of the audio signal so as to output at least the portion of the active noise cancelled version of the audio signal.

Clause 12. The apparatus of clause 1, wherein the means for dynamically lowering the application of the active noise cancellation comprises:

means for, when the estimated noise level is greater than or equal to a threshold level, dynamically lowering a gain of at least an active noise cancellation filter to be applied to a first portion of the audio signal so as to output a first portion of the active noise cancelled version of the audio signal, setting a counter to a value greater than one, and decreasing the value of the counter by one;

means for, when the value of the counter is equal to zero, determining whether a recently updated estimate noise level exceeds the threshold level; and means for, when the recently updated estimate noise level exceeds the threshold value, dynamically lowering the gain of the active noise cancellation filter to be applied to a second portion of the audio signal so as to output a second portion of the active noise cancelled version of the audio signal, resetting the counter to the value greater than one, and decreasing the value of the counter by one.

Clause 13. The apparatus of clause 1, wherein the means for dynamically lowering the application of the active noise cancellation comprises means for, when the estimated noise level is greater than or equal to a threshold level, dynamically lowering a gain of an active noise cancellation filter to be applied to at least a first portion of the audio signal so as to output a first portion of the active noise cancelled version of the audio signal, setting a counter to a value greater than one, and decreasing the value of the counter by one, and wherein the apparatus further comprises:

means for when the value of the counter is equal to zero, determining whether a recently updated estimate noise level exceeds the threshold level; and means for, when the recently updated estimate noise level is less than the threshold value, dynamically resetting the gain of the active noise cancellation filter to a value of the gain used prior to dynamically adjusting the gain.

Clause 14. The apparatus of clause 1, further comprising means for, when the estimated noise level is greater than or equal to a first threshold level, enabling the dynamic lowering of at least the portion of the audio signal, wherein the means for dynamically lowering the application of the active noise cancellation comprises means for, when the estimated noise level is greater than or equal to a second threshold level, dynamically lowering a gain of an active noise cancellation filter to be applied to at least a portion of the audio signal so as to output at least the portion of the active noise cancelled version of the audio signal.

Clause 15. The apparatus of clause 1, further comprising means for performing noise estimation with respect to a reference noise audio signal to obtain the estimated noise level.

Clause 16. The apparatus of clause 15, wherein the means for performing the noise estimation comprises means for determining the estimated noise level as an average amplitude, a peak amplitude, or an average power of at least a portion of a reference noise audio signal.

Clause 17. The apparatus of clause 15, wherein the means for performing the noise estimation comprises:

means for performing a non-wind noise estimation with respect to the reference noise audio signal to obtain a first estimated noise level;

means for performing a wind noise estimation with respect to the reference noise audio signal to obtain a second estimated noise level; and means for determining the estimated noise level as a function of the first estimated noise level and the second estimated noise level.

Clause 18. The apparatus of clause 1, further comprising:

means for performing echo cancellation with respect to the audio signal to obtain an echo cancelled audio signal; and means for applying the active noise cancellation to at least the portion of the echo cancelled audio signal.

The foregoing described techniques may also enable a non-transitory computer-readable storage medium having stored thereon instructions that, when executed, cause one or more processors to, when an estimated noise level increases, dynamically lower application of active noise cancellation to at least a portion of an audio signal to obtain at least a portion of an active noise cancelled version of the audio signal.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various embodiments of the invention have been described. These and other embodiments are within the scope of the following claims.

The invention claimed is:

1. A method comprising:

performing noise estimation with respect to a reference noise audio signal to obtain an estimated noise level;

when the estimated noise level increases, dynamically lowering application of active noise cancellation by, at least in part, dynamically specifying new filter coefficients for an active noise cancellation filter such that the active noise cancellation filter has a lower gain; and applying the active noise cancellation filter having the new filter coefficients to at least the portion of the audio signal to obtain at least a portion of an active noise cancelled version of the audio signal.

2. The method of claim 1, wherein dynamically lowering the application of the active noise cancellation comprises, when the estimated noise level increases, dynamically lowering application of non-adaptive active noise cancellation.

3. The method of claim 1, wherein dynamically lowering the application of the active noise cancellation comprises, when the estimated noise level increases, dynamically lowering application of adaptive active noise cancellation.

4. The method of claim 1, wherein applying the active noise cancellation filter comprises applying the active noise cancellation filter to dynamically lower a gain of at least the portion of the audio signal based on the estimated noise level.

5. The method of claim 1, applying the active noise cancellation filter comprises applying the active noise cancellation filter to dynamically set a gain of at least the portion of the audio signal to be zero based on the estimated noise level.

6. The method of claim 1, wherein dynamically lowering the application of the active noise cancellation comprises, when the estimated noise level increases above a threshold level, dynamically lowering the gain of the active noise cancellation filter by, at least in part, specifying the new filter coefficients for the active noise cancellation filter.

7. The method of claim 1, wherein dynamically lowering the application of the active noise cancellation comprises dynamically lowering, based on a mathematical function of the estimated noise level, the gain of the active noise cancellation filter by, at least in part, specifying the new filter coefficients for the active noise cancellation filter.

8. The method of claim 1, wherein dynamically lowering the application of the active noise cancellation comprises dynamically lowering the gain of the active noise cancellation filter to be equivalent to a gain determined using the estimated noise level as a key into a look-up table.

9. The method of claim 1, wherein dynamically lowering the application of the active noise cancellation comprises dynamically setting, based on the estimated noise level, gain of the active noise cancellation filter to be zero prior to applying the active noise cancellation filter to at least the portion of the audio signal.

10. The method of claim 1, wherein dynamically lowering the application of the active noise cancellation comprises:

comparing the estimated noise level to a threshold level; and when the estimated noise level is greater than or equal to the threshold level, dynamically adjusting the gain of the active noise cancellation filter.

11. The method of claim 1, wherein dynamically lowering the application of the active noise cancellation comprises:

when the estimated noise level is greater than or equal to a threshold level, dynamically lowering the gain of the active noise cancellation filter to be applied to a first portion of the audio signal so as to output a first portion of the active noise cancelled version of the audio signal, setting a counter to a value greater than one, and decreasing the value of the counter by one;

when the value of the counter is equal to zero, determining whether a recently updated estimate noise level exceeds the threshold level; and when the recently updated estimate noise level exceeds the threshold value, dynamically lowering the gain of the active noise cancellation filter to be applied to a second portion of the audio signal so as to output a second portion of the active noise cancelled version of the audio signal, resetting the counter to the value greater than one, and decreasing the value of the counter by one.

12. The method of claim 1, wherein dynamically lowering the application of the active noise cancellation comprises, when the estimated noise level is greater than or equal to a threshold level, dynamically lowering the gain of the active noise cancellation filter to be applied to at least a first portion of the audio signal so as to output a first portion of the active noise cancelled version of the audio signal, setting a counter to a value greater than one, and decreasing the value of the counter by one, and wherein the method further comprises:

when the value of the counter is equal to zero, determining whether a recently updated estimate noise level exceeds the threshold level; and when the recently updated estimate noise level is less than the threshold value, dynamically resetting the gain of the active noise cancellation filter to a value of the gain used prior to dynamically adjusting the gain.

13. The method of claim 1, further comprising, when the estimated noise level is greater than or equal to a first threshold level, enabling the dynamic lowering of at least the portion of the audio signal, wherein dynamically lowering the application of the active noise cancellation comprises, when the estimated noise level is greater than or equal to a second threshold level, dynamically lowering the gain of the active noise cancellation filter.

14. The method of claim 1, wherein performing the noise estimation comprises determining the estimated noise level as an average amplitude, a peak amplitude, or an average power of at least a portion of a reference noise audio signal.

15. The method of claim 1, wherein performing the noise estimation comprises:

performing a non-wind noise estimation with respect to the reference noise audio signal to obtain a first estimated noise level;

performing a wind noise estimation with respect to the reference noise audio signal to obtain a second estimated noise level; and determining the estimated noise level as a function of the first estimated noise level and the second estimated noise level.

16. The method of claim 1, further comprising:

performing echo cancellation with respect to the audio signal to obtain an echo cancelled audio signal; and applying the active noise cancellation filter to at least the portion of the echo cancelled audio signal.

17. An apparatus comprising:

a microphone configured to obtain a reference noise audio signal;

one or more processors configured to perform noise estimation with respect to the reference noise audio signal to obtain an estimated noise level, when an estimated noise level increases, dynamically lower application of active noise cancellation by, at least in part, dynamically specifying new filter coefficients for an active noise cancellation filter such that the active noise cancellation filter has a lower gain, and applying the active noise cancellation filter having the new filter coefficients to at least the portion of the audio signal to obtain at least a portion of an active noise cancelled version of the audio signal; and a memory configured to store at least the portion of the active noise cancelled version of the audio signal.

18. The apparatus of claim 17, wherein the one or more processors are configured to, when the estimated noise level increases, dynamically lower application of non-adaptive active noise cancellation.

19. The apparatus of claim 17, wherein the one or more processors are configured to, when the estimated noise level increases, dynamically lower application of adaptive active noise cancellation.

20. The apparatus of claim 17, wherein the one or more processors are configured to apply the active noise cancellation filter to dynamically lower a gain of at least the portion of the audio signal based on the estimated noise level.

21. The apparatus of claim 17, wherein the one or more processors are configured to apply the active noise cancellation filter to dynamically set a gain of at least the portion of the audio signal to be zero based on the estimated noise level.

22. The apparatus of claim 17, wherein the one or more processors are configured to, when the estimated noise level increases, dynamically lowering the gain of the active noise cancellation filter by, at least in part, specifying the new filter coefficients for the active noise cancellation filter.

23. The apparatus of claim 17, wherein the one or more processors are configured to dynamically lower the gain of the active noise cancellation filter to be equivalent to a gain determined using the estimated noise level as a key into a look-up table.

24. The apparatus of claim 17, wherein the one or more processors are configured to dynamically set, based on the estimated noise level, gain of the active noise cancellation filter to be zero prior to applying the active noise cancellation filter to at least the portion of the audio signal.

25. The apparatus of claim 17, wherein the one or more processors are configured to when the estimated noise level is greater than or equal to a threshold level, dynamically lowering the gain of the active noise cancellation filter to be applied to a first portion of the audio signal so as to output a first portion of the active noise cancelled version of the audio signal, setting a counter to a value greater than one, and decreasing the value of the counter by one;

when the value of the counter is equal to zero, determining whether a recently updated estimate noise level exceeds the threshold level; and when the recently updated estimate noise level exceeds the threshold value, dynamically lowering the gain of the active noise cancellation filter to be applied to a second portion of the audio signal so as to output a second portion of the active noise cancelled version of the audio signal, resetting the counter to the value greater than one, and decreasing the value of the counter by one.

26. The apparatus of claim 17, wherein the one or more processors are configured to, when the estimated noise level is greater than or equal to a threshold level, dynamically lowering the gain of the active noise cancellation filter to be applied to at least a first portion of the audio signal so as to output a first portion of the active noise cancelled version of the audio signal, setting a counter to a value greater than one, and decreasing the value of the counter by one, and wherein the one or more processors are further configured to, when the value of the counter is equal to zero, determining whether a recently updated estimate noise level exceeds the threshold level, and when the recently updated estimate noise level is less than the threshold value, dynamically resetting the gain of the active noise cancellation filter to a value of the gain used prior to dynamically adjusting the gain.

27. The apparatus of claim 17, wherein the one or more processors are further configured to, when the estimated noise level is greater than or equal to a first threshold level, enabling the dynamic lowering of at least the portion of the audio signal, and wherein the one or more processors are configured to, when the estimated noise level is greater than or equal to a second threshold level, dynamically lowering the gain of the active noise cancellation filter.

28. The apparatus of claim 17, wherein the one or more processors are further configured to perform echo cancellation with respect to the audio signal to obtain an echo cancelled audio signal, and apply the active noise cancellation filter to at least the portion of the echo cancelled audio signal.

* * * * *